US009948031B2

(12) United States Patent
Tamaki

(10) Patent No.: US 9,948,031 B2
(45) Date of Patent: Apr. 17, 2018

(54) ELECTRICAL CONNECTOR

(71) Applicant: HIROSE ELECTRIC CO., LTD., Tokyo (JP)

(72) Inventor: Shoichiro Tamaki, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/683,923

(22) Filed: Aug. 23, 2017

(65) Prior Publication Data

US 2018/0062315 A1 Mar. 1, 2018

(30) Foreign Application Priority Data

Aug. 26, 2016 (JP) ..... 2016-165555

(51) Int. Cl.

| | |
|---|---|
| ***H01R 13/62*** | (2006.01) |
| ***H01R 13/639*** | (2006.01) |
| ***H01R 12/72*** | (2011.01) |
| ***H01R 13/641*** | (2006.01) |

(52) U.S. Cl.

CPC ..... *H01R 13/639* (2013.01); *H01R 12/721* (2013.01); *H01R 13/641* (2013.01)

(58) Field of Classification Search

CPC ..... H01R 12/72
USPC ..... 439/325, 326
See application file for complete search history.

(56) References Cited

U.S. PATENT DOCUMENTS 3,373,706 A * 3/1968 Armstead, Jr. ..... D05B 1/20 112/162
3,970,353 A * 7/1976 Kaufman ..... E21C 35/08 439/325
4,487,468 A * 12/1984 Fedder ..... H01R 12/7005 439/325
4,846,730 A * 7/1989 Owen ..... H01R 12/88 439/260
5,468,156 A * 11/1995 Flinchbaugh ..... H01R 13/633 439/155

(Continued)

FOREIGN PATENT DOCUMENTS

CN 103001064 B 2/2015
JP 2011-119162 A 6/2011
JP 2013-239320 A 11/2013

*Primary Examiner* — Phuong Dinh
(74) *Attorney, Agent, or Firm* — Kubotera & Associates, LLC

(57) ABSTRACT

An electrical connector includes a housing including a receiving portion for inserting a flat conductive member; a plurality of terminals arranged in a terminal arrangement direction; a movable member; and a fixing metal member. The movable member includes a supported portion and an engaging portion. The supported portion is supported on the housing to be movable between an open position and a closed position. The engaging portion engages with the flat conductive member when the movable member is situated at the closed position. The fixing metal member includes a fixing portion to be fixed to an electrical circuit board; a regulating portion for restricting the movable member; and an engaging section for engaging with the movable member. The fixing metal member includes leg portions extending toward the electrical circuit board. The fixing portion, the regulating portion, and the engaging portion are disposed on the leg portions.

5 Claims, 7 Drawing Sheets

(56) References Cited

U.S. PATENT DOCUMENTS

| | | | | |
|---|---|---|---|---|
| 7,507,112 | B2 * | 3/2009 | Mundt | H01R 13/193 439/357 |
| 2011/0136365 | A1 | 6/2011 | Hara | |

* cited by examiner

ELECTRICAL CONNECTOR

BACKGROUND OF THE INVENTION AND RELATED ART STATEMENT

The present invention relates to an electrical connector to be connected to a flat conductive member. More specifically, the present invention relates to an electrical connector to be mounted on a mounting surface of an electrical circuit board, so that the electrical connector is connected to the flat conductive member.

A conventional electrical connector is configured such that a flat conductive member is inserted into the conventional electrical connector. The flat conductive member is provided with an electrical circuit portion at a front edge portion thereof. Accordingly, when the flat conductive member is inserted into the conventional electrical connector, the electrical circuit portion at the front edge of the flat conductive member is connected to a terminal of the conventional electrical connector with a contact pressure. Further, the conventional electrical connector is configured such that the flat conductive member does not easily come off from the conventional electrical connector.

Patent Reference has disclosed the conventional electrical connector to be connected to the flat conductive member. The flat conductive member is inserted into a housing of the conventional electrical connector such that a surface of the front edge portion of the flat conductive member is aligned in parallel to a mounting surface of the electrical circuit board. The conventional electrical connector includes a supporting metal member and a locking portion disposed on the supporting member. The locking portion is configured to elastically deform. Further, the flat conductive member includes an engaging portion having a cut shape. When the flat conductive member is inserted into the conventional electrical connector, the locking portion engages with the engaging portion, so that the flat conductive member does not come off from the conventional electrical connector.

Patent Reference: Japanese Patent Publication No. 2011-119162

In the conventional electrical connector disclosed in Patent Reference, the supporting metal member is formed of a metal plate bent in a thickness direction thereof. The supporting metal member is arranged such that a width direction thereof is aligned with a terminal arrangement direction of the conventional electrical connector. Further, the supporting metal member is held with the housing of the conventional electrical connector.

In the conventional electrical connector disclosed in Patent Reference, the supporting metal member includes an electrical circuit board attaching portion at a most outside position thereof in the terminal arrangement direction of the conventional electrical connector. The electrical circuit board attaching portion is formed in a leg shape and is configured to protrude outwardly. The electrical circuit board attaching portion is mounted on and held with the electrical circuit board with solder. Further, the supporting metal member includes the locking portion, a lock releasing portion, and a cut portion. The cut portion is configured such that the lock releasing portion can be operated. The supporting metal member is disposed at both end portions of the conventional electrical connector in the terminal arrangement direction.

In the conventional electrical connector, the locking portion is formed of a plate member extending in the terminal arrangement direction and a pulling and inserting direction of the flat conductive member. Further, the locking portion is configured to elastically deform in a thickness direction thereof, that is, a vertical direction. The locking portion includes an engaging section at an end portion thereof in the terminal arrangement direction. The engaging section is formed in a triangular shape, and is bent upwardly.

In the conventional electrical connector, the engaging section is formed in a saw shape having an inclined surface and an engaging edge portion. The inclined surface is formed to incline upwardly toward the inserting direction, so that the inclined surface can guide the flat conductive member. The engaging edge portion is disposed at a front edge portion of the inclined surface, and is configured to extend in a direction perpendicular to the inserting direction.

In the conventional electrical connector, when the flat conductive member is inserted into the conventional electrical connector, the engaging section receives an insertion force at the inclined surface thereof from a lower surface of the flat conductive member. Accordingly, the locking portion is elastically deformed downwardly, so that the flat conductive member can be further inserted. When the flat conductive member is inserted up to a specific position, the engaging portion of the flat conductive member with the cut shape is moved over the inclined surface. Accordingly, the locking portion is restored from the elastically deformed state to a free state. As a result, the engaging portion of the flat conductive member engages with the engaging edge portion formed at the front edge portion of the engaging section, so that the flat conductive member does not come off from the conventional electrical connector.

As described above, in the conventional electrical connector, when the flat conductive member is inserted into the conventional electrical connector up to the specific position, the engaging portion of the flat conductive member automatically engages with the section of the locking portion, so that the flat conductive member does not come off from the conventional electrical connector.

In the conventional electrical connector, the lock releasing portion is disposed in the cut portion of the locking portion for releasing the flat conductive member from the conventional electrical connector. The lock releasing portion is configured to protrude from an upper surface of the locking portion. The cut portion is arranged to guide the lock releasing portion in the vertical direction while the cut portion is restricting the lock releasing portion from moving in the lateral direction.

In the conventional electrical connector, when the flat conductive member is disengaged from the locking portion, the upper surface of the lock releasing portion is pushed downwardly. Accordingly, the lock releasing portion is moved downwardly, and the upper surface of the locking portion is elastically deformed downwardly. As a result, the engaging section of the locking portion is disengaged from the engaging portion of the flat conductive member, so that the flat conductive member can be pulled out from the conventional electrical connector.

As described above, in the conventional electrical connector, the supporting metal member includes the electrical circuit board attaching portion protruding outwardly in the terminal arrangement direction of the conventional electrical connector. Accordingly, it is possible to securely attach the conventional electrical connector to the electrical circuit board. On the other hand, it is difficult to reduce a size of the conventional electrical connector in the terminal arrangement direction thereof.

Further, in the conventional electrical connector, the supporting metal member includes the cut portion for guiding the lock releasing portion. The cut portion of the supporting metal member tends to extend further in the terminal arrangement direction of the conventional electrical connector. Therefore, it is further difficult to reduce the size of the conventional electrical connector in the terminal arrangement direction thereof. Moreover, the supporting metal member is disposed on the both end portions of the conventional electrical connector. Accordingly, the size of the conventional electrical connector in the terminal arrangement direction thereof tends to increase further.

In general, in the conventional electrical connector, the terminals are arranged in a small arrangement pitch, that is, more densely to reduce the size of the conventional electrical connector. However, when the conventional electrical connector includes the locking portion described above, the size of the conventional electrical connector in the terminal arrangement direction thereof tends to increase. Accordingly, it is difficult to reduce the size of the conventional electrical connector in the terminal arrangement direction thereof.

In view of the problems described above, an object of the present invention is to provide an electrical connector to be connected to the flat conductive member capable of solving the problems. In the electrical connector, it is possible to securely attach the electrical connector to the electrical circuit board, and securely prevent the flat conductive member from coming off from the electrical connector. Further, it is possible to guide and restrict the flat conductive member, and to reduce a size of the electrical connector in the terminal arrangement direction thereof.

Further objects and advantages of the present invention will be apparent from the following description of the present invention.

SUMMARY OF THE INVENTION

In order to attain the objects described above, according to a first aspect of the present invention, an electrical connector is to be mounted on an electrical circuit board, and to be connected to a flat conductive member According to the first aspect of the present invention, the electrical connector includes a housing; a plurality of terminals; a movable member; and a fixing metal member. The housing includes a receiving portion as a space formed to open at least in a backward direction, so that the flat conductive member extending in a front-to-back direction is inserted into the receiving portion from a front end portion thereof. The terminals are held in the housing and arranged in a terminal arrangement direction, that is, a width direction of the flat conductive member perpendicular to the front-to-back direction.

According to the first aspect of the present invention, the movable member includes a supported portion and an engaging portion facing in the backward direction. The supported portion is configured to be supported on the housing, so that the movable member is movable between an open position and a closed position relative to the housing. The engaging portion is configured to be able to engage with an engaged portion formed in the flat conductive member when the movable member is situated at the closed position. The fixed metal member is held with the housing outside a terminal arrangement range, and is to be fixed to a mounting surface of the electrical circuit board.

According to the first aspect of the present invention, in the electrical connector, the fixing metal member is formed of a metal plate configured such that a plate surface of the metal plate is bent in a direction perpendicular to the terminal arrangement direction. Further, the fixing metal member includes a fixing portion to be fixed to the electrical circuit board; a regulating portion for restricting a position of the supported portion of the movable member; and an engaging section for engaging with a portion of the movable member so that the movable member is maintained at one of the open position and the closed position.

According to the first aspect of the present invention, in the electrical connector, the fixing metal member further includes a plurality of leg portions extending toward the mounting surface of the electrical circuit board. The leg portions are connected to each other. Each of the fixing portion, the regulating portion, and the engaging portion is disposed on one of the leg portions.

As described above, according to the first aspect of the present invention, in the electrical connector, when the movable member is rotated to the closed position, the engaging portion of the movable member prevents the electrical circuit board from coming off. When the flat conductive member is pulled out, the movable member is rotated to the open position and the flat conductive member is pulled in the backward direction, so that the flat conductive member can be pulled out.

As described above, according to the first aspect of the present invention, in the electrical connector, the fixing metal member is formed of the metal plate configured such that the plate surface of the metal plate is bent in the direction perpendicular to the terminal arrangement direction. Accordingly, the plate thickness of the fixing metal member is aligned with the terminal arrangement direction. As a result, it is possible to significantly reduce a size of the electrical connector in the terminal arrangement direction.

As described above, according to the first aspect of the present invention, in the electrical connector, the fixing metal member having the plate surface perpendicular to the terminal arrangement direction includes the leg portions. One of the leg portions is provided with the fixing portion to be fixed to the electrical circuit board, the regulating portion for restricting the position of the supported portion of the movable member, or the engaging section for maintaining the movable member at one of the opening position and the closed position. In other ward, the fixing metal member is formed as one component, and includes the fixing portion, the regulating portion, and the engaging section. Accordingly, it is possible to minimize the number of the components of the electrical connector. Further, the leg portions of the fixing metal member extend in the one same direction. Accordingly, the fixing metal member can be inserted into the housing in the one same direction, thereby making it possible to easily assemble the electrical connector.

According to a second aspect of the present invention, in the electrical connector in the first aspect, the fixing metal member may include the fixing portion disposed on each of two of the leg portions situated both outside positions in a direction that the leg portions are arranged. When the fixing portion is disposed on each of the leg portions situated at the outside position, it is possible to fix the fixing metal member to the electrical circuit board at the two positions. Further, the fixing portions are apart by a largest distance, so that the fixing metal member can be securely fixed to the electrical circuit board.

According to a third aspect of the present invention, in the electrical connector in the first aspect, it may be configured such that the movable member is urged toward an original position. When the flat conductive member is inserted into the electrical connector, the flat conductive member pushes the movable member to move away from the original position, so that the flat conductive member can be further inserted. When the flat conductive member is completely inserted into the electrical connector up to the specific position, the movable member is urged and returned to the original position. With the configuration described above, when the flat conductive member is simply inserted into the electrical connector in the forward direction, it is possible to engage the engaging portion of the movable member with the engaged portion of the flat conductive member. Accordingly, it is possible to easily connect the flat conductive member to the electrical connector.

According to a fourth aspect of the present invention, in the electrical connector in the first aspect, the movable member may be configured to be rotatable. Further, the engaging portion of the movable member may be situated outside a terminal arrangement range. Further, the receiving portion of the housing may be configured such that the flat conductive member can be inserted and pulled out in a direction perpendicular to the mounting surface of the electrical circuit board.

As described above, according to the present invention, the electrical connector includes the fixing metal member for fixing the electrical connector to the electrical circuit board. The fixing metal member is configured to have the plate surface perpendicular to the terminal arrangement direction. Further, on the plate surface thereof, the fixing metal member includes the fixing portion to be fixed to the electrical circuit board, the regulating portion for restricting the position of the supported portion of the movable member, and the engaging section for maintaining the movable member at one of the opening position and the closed position. Accordingly, it is possible to significantly reduce the size of the electrical connector in the terminal arrangement direction.

Further, according to the present invention, the fixing metal member is configured to have one plate surface. Accordingly, the fixing metal member has the simple shape, and can be easily produced. Further, one of the leg portions of the fixing metal member is provided with the fixing portion, the regulating portion, or the engaging section. Accordingly, it is possible to minimize the number of the components of the electrical connector. Further, the leg portions of the fixing metal member extend in the one same direction. Accordingly, the fixing metal member can be inserted into the housing in the one same direction, thereby making it possible to easily assemble the electrical connector.

BRIEF DESCRIPTION OF THE DRAWINGS

FIGS. 3(A) through 3(C) are sectional views showing the electrical connector for connecting the flat conductive member taken along a plane perpendicular to a terminal arrangement direction of the electrical connector according to the first embodiment of the present invention, wherein FIG. 3(A) is a sectional view showing the electrical connector taken at a location of a signal terminal of the electrical connector, FIG. 3(B) is a sectional view showing the electrical connector taken at a location of a ground terminal of the electrical connector, and FIG. 3(C) is a sectional view showing the electrical connector taken at a location of a fixing metal member of the electrical connector;

FIGS. 4(A) and 4(B) are sectional views showing the electrical connector for connecting the flat conductive member taken along at the location of the fixing metal member of the electrical connector according to the first embodiment of the present invention, wherein FIG. 4(A) is a sectional view showing the electrical connector when a movable member of the electrical connector is situated at a closed position, and FIG. 4(B) is a sectional view showing the electrical connector when the movable member of the electrical connector is situated at an open position;

FIGS. 5(A) through 5(C) are sectional views showing the electrical connector for connecting the flat conductive member in a process of inserting the flat conductive member into the electrical connector taken at a location of an engaging portion of the movable member of the electrical connector in the terminal arrangement direction of the electrical connector according to the first embodiment of the present invention, wherein FIG. 5(A) is a sectional view showing the electrical connector before the flat conductive member is inserted into the electrical connector, FIG. 5(B) is a sectional view showing the electrical connector when the movable member of the electrical connector is situated at the open position, and FIG. 5(C) is a sectional view showing the electrical connector when the flat conductive member is completely inserted into the electrical connector;

FIGS. 6(A) through 6(C) are sectional views showing the electrical connector for connecting the flat conductive member in a process of pulling out the flat conductive member from the electrical connector taken at the location of the engaging portion of the movable member of the electrical connector in the terminal arrangement direction of the electrical connector according to the first embodiment of the present invention, wherein FIG. 6(A) is a sectional view showing the electrical connector when the movable member of the electrical connector is situated at the open position, FIG. 6(B) is a sectional view showing the electrical connector when the flat conductive member is pulled out from the electrical connector, and FIG. 6(C) is a sectional view showing the electrical connector when the flat conductive member is completely pulled out from the electrical connector.

DETAILED DESCRIPTION OF THE PREFERRED EMBODIMENTS

Hereunder, embodiments of the present invention will be described with reference to the accompanying drawings.

First Embodiment

A first embodiment of the present invention will be explained.

Figure 1:
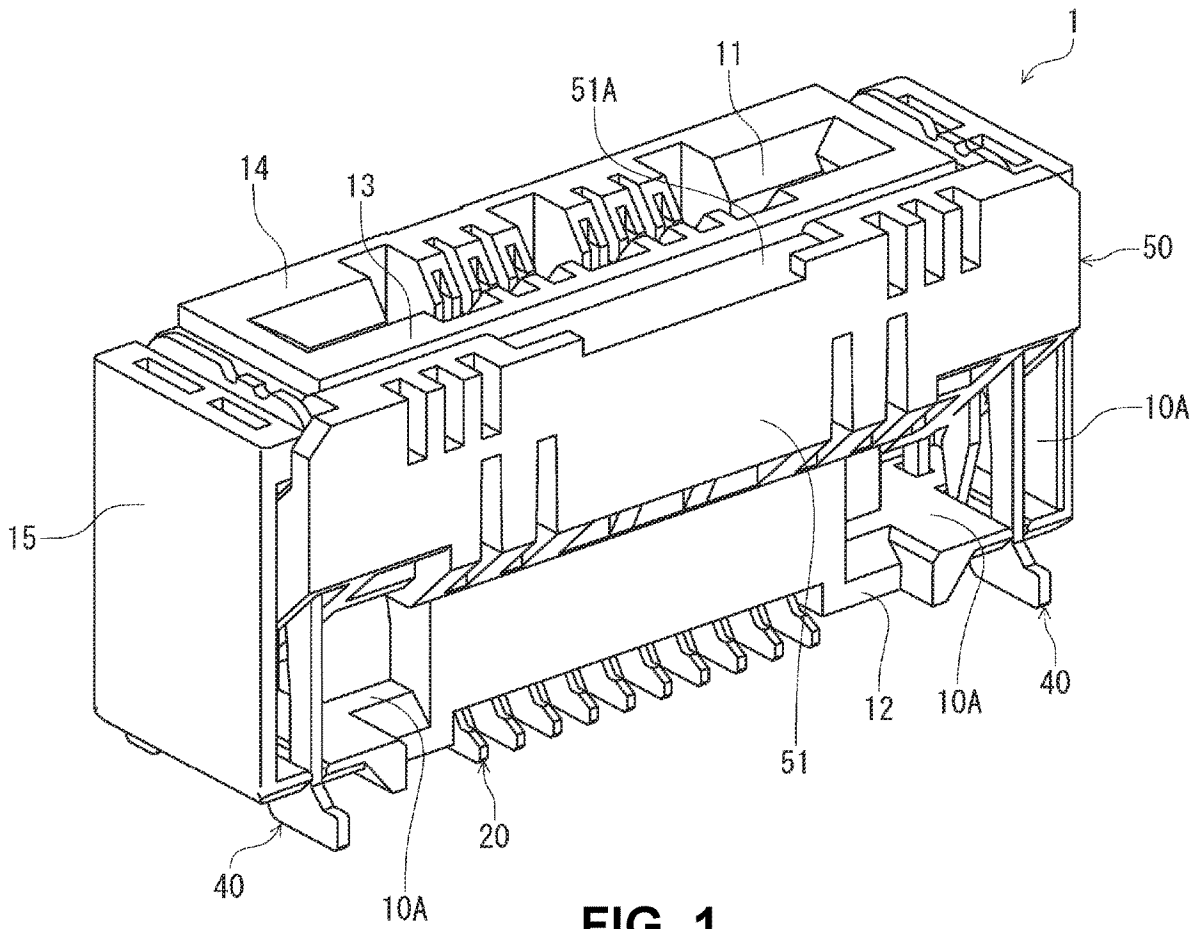
FIG. 1 is a perspective view showing an electrical connector for connecting a flat conductive member according to a first embodiment of the present invention.
Figure 2:
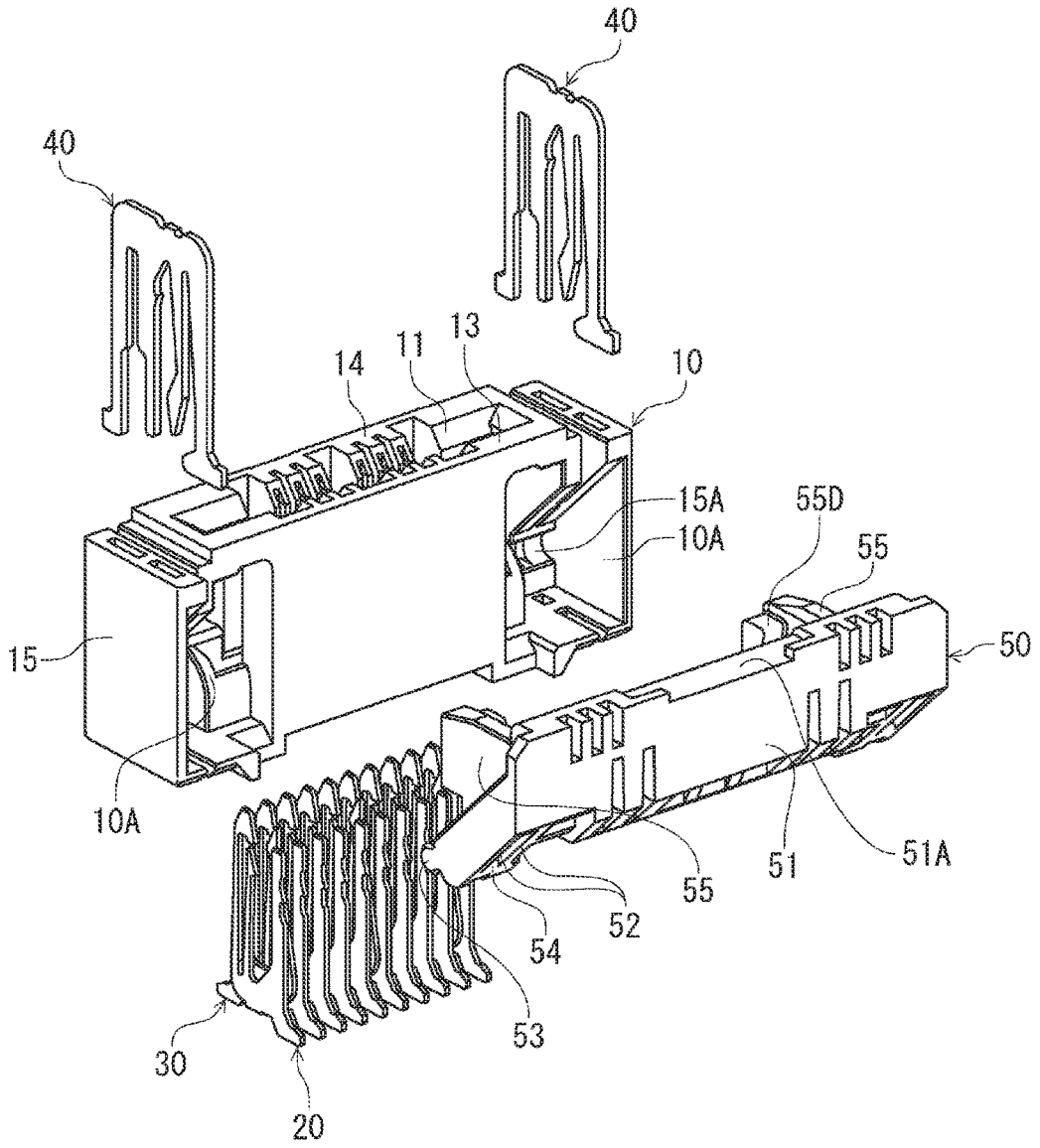
FIG. 2 is an exploded perspective view showing the electrical connector for connecting the flat conductive member according to the first embodiment of the present invention.

FIG. 1 is a perspective view showing an electrical connector 1 for connecting a flat conductive member C according to the first embodiment of the present invention. FIG. 2 is an exploded perspective view showing the electrical connector 1 for connecting to a circuit portion of the flat conductive member C according to the first embodiment of the present invention.

FIGS. 3(A) through 3(C) are sectional views showing the electrical connector 1 for connecting the flat conductive member C taken along a plane perpendicular to a terminal arrangement direction of the electrical connector 1 according to the first embodiment of the present invention. More specifically, FIG. 3(A) is a sectional view showing the electrical connector 1 taken at a location of a signal terminal 20 of the electrical connector 1, FIG. 3(B) is a sectional view showing the electrical connector 1 taken at a location of a ground terminal 30 of the electrical connector 1, and FIG. 3(C) is a sectional view showing the electrical connector 1 taken at a location of a fixing metal member 40 of the electrical connector 1.

Figure 4:
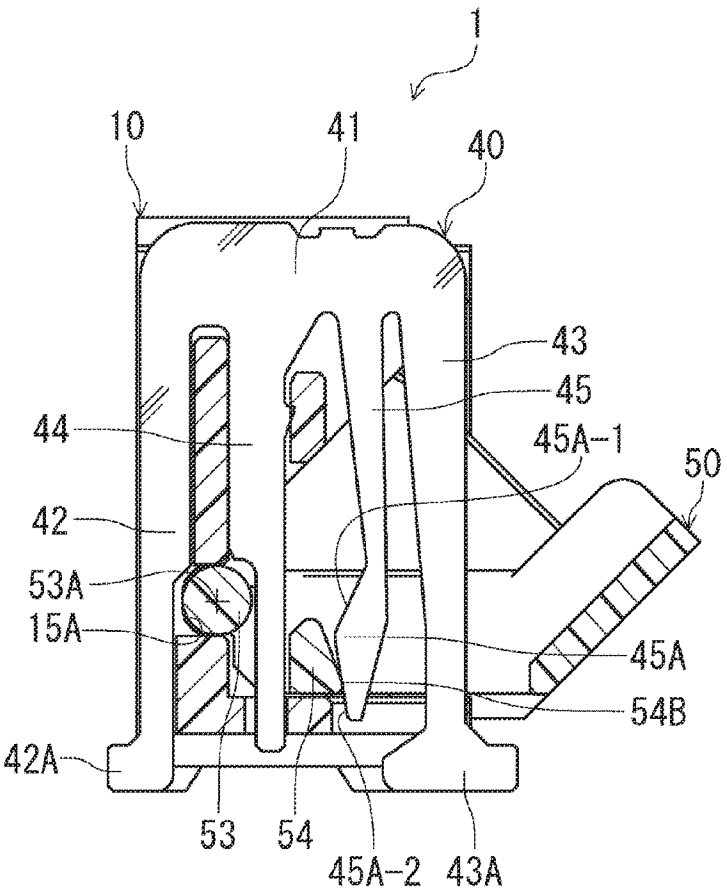
Figure 4:
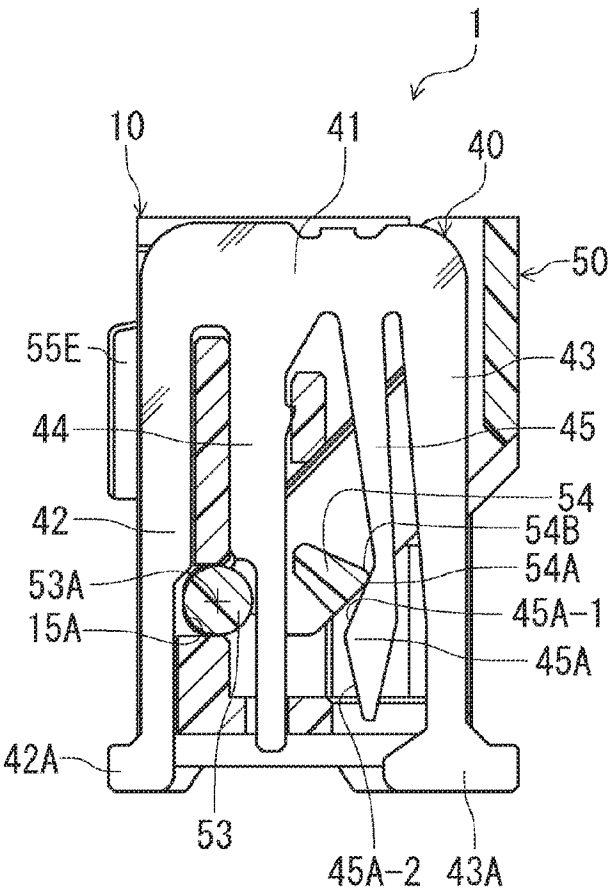

FIGS. 4(A) and 4(B) are sectional views showing the electrical connector 1 for connecting the flat conductive member C taken along at the location of the fixing metal member 40 of the electrical connector 1 according to the first embodiment of the present invention. More specifically, FIG. 4(A) is a sectional view showing the electrical connector 1 when a movable member 50 of the electrical connector 1 is situated at a closed position, and FIG. 4(B) is a sectional view showing the electrical connector 1 when the movable member 50 of the electrical connector 1 is situated at an open position.

Figure 5:
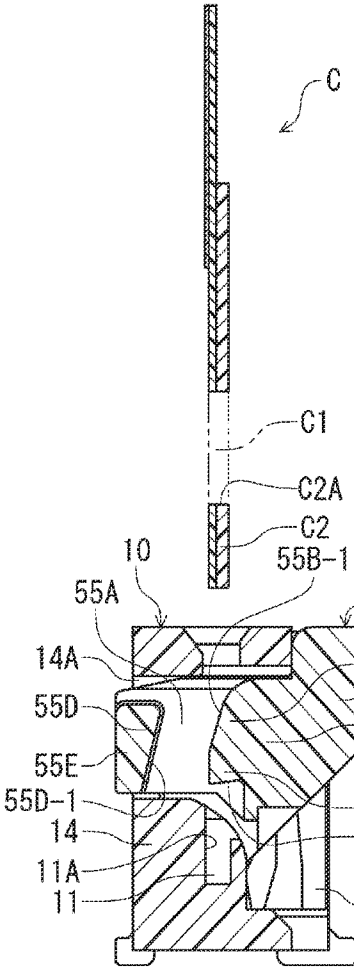
Figure 5:
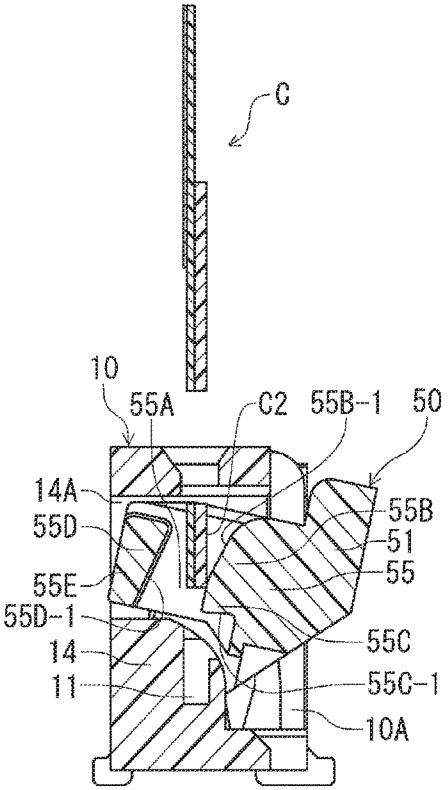
Figure 5:
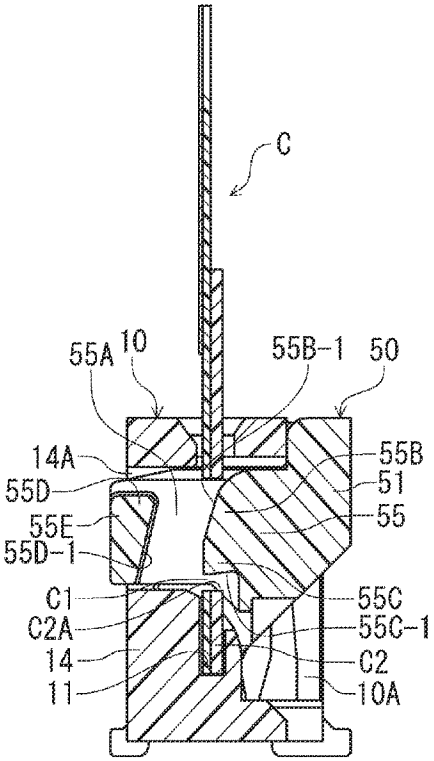

FIGS. 5(A) through 5(C) are sectional views showing the electrical connector 1 for connecting the flat conductive member C in a process of inserting the flat conductive member C into the electrical connector 1 taken at a location of an engaging portion 55C of the movable member 50 of the electrical connector 1 in the terminal arrangement direction of the electrical connector 1 according to the first embodiment of the present invention. More specifically, FIG. 5(A) is a sectional view showing the electrical connector 1 before the flat conductive member C is inserted into the electrical connector 1, FIG. 5(B) is a sectional view showing the electrical connector 1 when the movable member 50 of the electrical connector 1 is situated at the open position, and FIG. 5(C) is a sectional view showing the electrical connector 1 when the flat conductive member C is completely inserted into the electrical connector 1.

Figure 6:
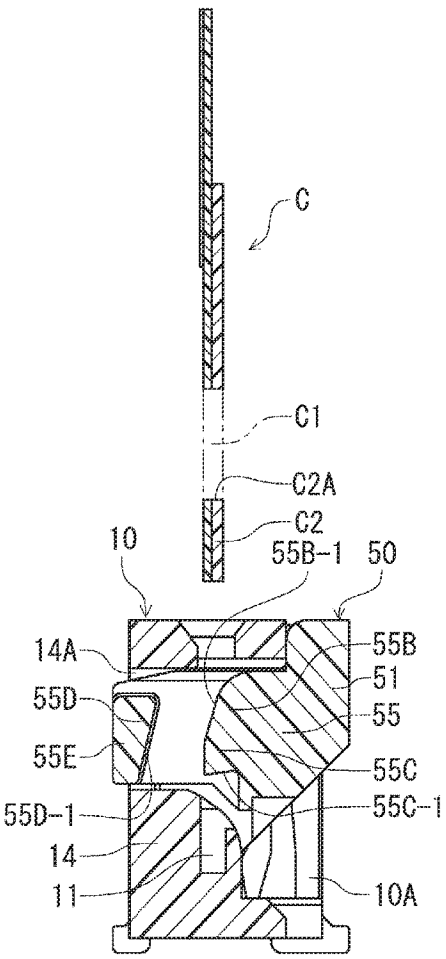
Figure 6:
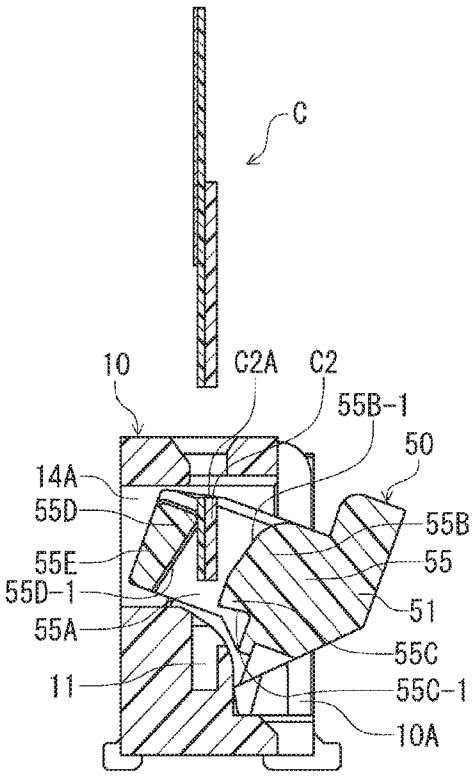
Figure 6:
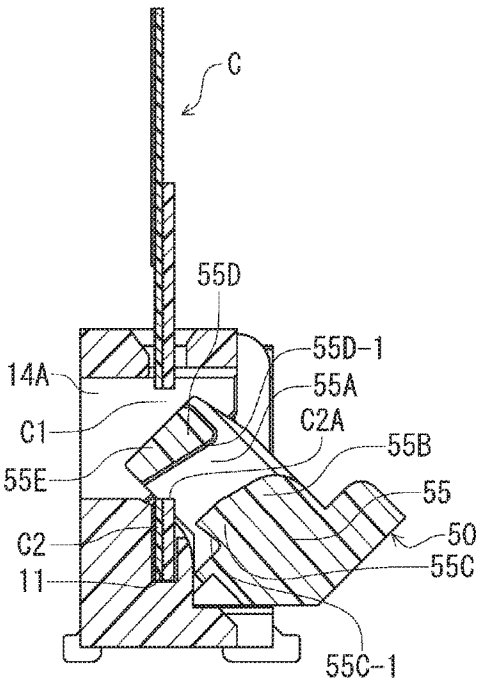

FIGS. 6(A) through 6(C) are sectional views showing the electrical connector 1 for connecting the flat conductive member C in a process of pulling out the flat conductive member C from the electrical connector 1 taken at the location of the engaging portion 55C of the movable member 50 of the electrical connector 1 in the terminal arrangement direction of the electrical connector according to the first embodiment of the present invention 1. More specifically, FIG. 6(A) is a sectional view showing the electrical connector 1 when the movable member 50 of the electrical connector 1 is situated at the open position, FIG. 6(B) is a sectional view showing the electrical connector 1 when the flat conductive member C is pulled out from the electrical connector 1, and FIG. 6(C) is a sectional view showing the electrical connector 1 when the flat conductive member C is completely pulled out from the electrical connector 1.

In the first embodiment, the electrical connector 1 is to be disposed on a mounting surface of an electrical circuit board (not illustrated). When the flat conductive member C is connected to the electrical connector 1 from above, the flat conductive member C is electrically connected to the electrical circuit board. In the following description, the electrical circuit board is defined as a flat mounting member with a plate shape, on which a circuit portion is mounted so that the circuit portion is connected to a terminal of the electrical connector 1. The electrical circuit board is not limited to the flat mounting member with the plate shape and high rigidity. Alternatively, the electrical circuit board may include a flexible member with a sheet shape and low rigidity similar to the flat conductive member C.

In the first embodiment, a plurality of terminals, that is, the signal terminals 20 and the ground terminals 30, is continuously arranged with specific intervals in a terminal arrangement range. More specifically, as shown in FIG. 2, the signal terminals 20 and the ground terminals 30 (described later) are arranged with the specific intervals within the terminal arrangement range. Hereunder, when it is not necessary to differentiate the signal terminals 20 and the ground terminals 30, the signal terminals 20 and the ground terminals 30 are collectively referred to as the terminals 20 and 30.

As shown in FIGS. 5(A)-5(C) and 6(A)-6(C), the flat conductive member C is formed in a band shape, so that the flat conductive member C is inserted into and pulled out from the electrical connector in a posture that the flat conductive member C extends in a vertical direction perpendicular to the mounting surface of the electrical circuit board. It should be noted that an insertion direction of the flat conductive member C is a downward direction, and a pulling out direction of the flat conductive member C is an upward direction in FIGS. 5(A)-5(C) and 6(A)-6(C). Further, in the following description, a front side and a rear side of the flat conductive member C are based on the insertion direction of the flat conductive member C, that is, a lower side and an upper side of the flat conductive member C in FIGS. 5(A)-5(C) and 6(A)-6(C).

In the first embodiment, the flat conductive member C includes a plurality of circuit portions (not illustrated) extending in the front-to-back direction (the vertical direction) of the flat conductive member C. The circuit portions are arranged in a width direction (a direction perpendicular to the front-to-back direction).

In the first embodiment, the circuit portions are embedded within an electrically insulated layer of the flat conductive member C, and extend up to a front end portion (a lower end portion) of the flat conductive member C. Moreover, the circuit portions include both signal circuit portions and ground circuit portions. The signal circuit portion includes a front side edge portion exposed from one surface of the flat conductive member C (on the left side in FIGS. 5(A)-5(C) and 6(A)-6(C)), so that the signal circuit portion contacts with the signal terminal 20. The ground circuit portion includes a front side edge portion exposed from the other surface of the flat conductive member C, so that the ground circuit portion contacts with the ground terminal 30.

In the first embodiment, the flat conductive member C includes a cut portion C1 in both side edges of a front end portion thereof (refer to FIGS. 5(A)-5(C) and 6(A)-6(C)). Further, the flat conductive member C includes an ear shape portion C2 in front of (on a lower side of) the cut portion C1. The ear shape portion C2 includes an engaged portion C2A at a rear edge (an upper edge) thereof, so that the engaged portion C2A engages with an engaging portion 55C of the movable member 50 of the electrical connector 1 (refer to FIG. 5(C), described later).

As shown in FIGS. 1 and 2, the electrical connector 1 includes a housing 10; a plurality of signal terminals 20; a plurality of ground terminals 30; the fixing metal member 40; and the movable member 50. The housing 10 is formed in a parallelepiped shape and is formed of an electrically insulating material. The signal terminals 20 and the ground terminals 30 are formed of metal and arranged in and held with the housing 10 in the terminal arrangement direction aligned with a longitudinal direction of the housing 10.

In the first embodiment, the fixing metal member 40 is held with the housing 10 at both outside end positions within the arrangement range of the terminals 20 and 30. The movable member 50 is formed of an electrically insulating material, and is supported on the housing 10, so that the movable member 50 is movable (rotatable) between a closed position and an open position (described later).

An operation of inserting and pulling out the flat conductive member C into and from the electrical connector 1 will be explained. Afterward, a configuration of the electrical connector 1 will be explained in more detail.

As shown in FIG. 1, before the flat conductive member C is inserted into the electrical connector 1, the movable member 50 of the electrical connector 1 is situated at the closed position, so that the flat conductive member C can be inserted into the electrical connector 1. Further, after the flat conductive member C is inserted into the electrical connector 1, the movable member 50 of the electrical connector 1 is maintained at the closed position (a pulling out preventing position). When the movable member 50 of the electrical connector 1 is maintained at the closed position, the engaging portion 55C of the movable member 50 is able to engage with the engaged portions C2A of the flat conductive member C (described later). As a result, the flat conductive member C is prevented from being pulled out backwardly (upwardly) from the electrical connector 1 (refer to FIG. 5(C)).

In the first embodiment, when the flat conductive member C is pulled out from the electrical connector 1, and the electrical connector 1 is not in use, the movable member 50 is rotated and switched to the open position. Accordingly, the engaging portion 55C of the movable member 50 is disengaged and released from the engaged portions C2A of the flat conductive member C (refer to FIG. 6(A)). Afterward, when the flat conductive member C is pulled backwardly (upwardly), the movable member 50 receives an abutting force from the engaged portions C2A of the flat conductive member C at a pressure receiving portion 55D thereof (described later). As a result, the movable member 50 is rotated toward the closed position.

In the first embodiment, when the movable member 50 is rotated toward the closed position, a penetrating groove portion 56A of the movable member 50 (described later) is situated on a path of the engaged portions C2A. Accordingly, the flat conductive member C can be pulled out backwardly. Even after the flat conductive member C is completely pulled out from the electrical connector 1, the movable member 50 continues to rotate and is automatically moved to the closed position. As described above, when the flat conductive member C is pulled out from the electrical connector 1, the movable member 50 is rotated to the closed position in one single operation.

The configuration of the electrical connector 1 will be explained next. As shown in FIG. 1, the housing 10 extends in a longitudinal direction as a direction in parallel to the mounting surface of the electrical circuit board (not illustrated). The housing 10 includes a receiving portion 11 as a space opened backwardly, so that the flat conductive member C can be inserted into the housing 10 through the receiving portion 11.

In the first embodiment, the housing 10 includes a bottom wall portion 12; a first sidewall portion 13; a second second sidewall portion 14; and a edge wall portion 15. The bottom wall portion 12 is arranged to face the mounting surface of the electrical circuit board, and extends in a direction in parallel to the mounting surface of the electrical circuit board. The first sidewall portion 13 is arranged to face the second sidewall portion 14 in a connector width direction (a lateral direction of the housing 10 perpendicular to the terminal arrangement direction).

Further, the first sidewall portion 13 and the second sidewall portion 14 (collectively referred to as the sidewall portions 13 and 14) extend in the terminal arrangement direction over the terminal arrangement range. The edge wall portion 15 is arranged to extend upwardly and in the connector width direction from both end portions of the bottom wall portion 12 in the terminal arrangement direction. Further, the edge wall portion 15 is configured to connect end portions of the first sidewall portion 13 and the second sidewall portion 14.

As shown in FIG. 1, the receiving portion 11 is arranged to extend in the terminal arrangement direction, and is surrounded with the bottom wall portion 12, the first sidewall portion 13, the second sidewall portion 14, and the edge wall portion 15. Further, the receiving portion includes an opening portion opened upwardly. Accordingly, the receiving portion 11 receives the front edge portion of the flat conductive member C (the lower edge portions in FIGS. 5(A)-5(C) and 6(A)-6(C)) in a space thereof extending from the opening portion thereof to an upper surface of the bottom wall portion 12 in the vertical direction (refer to FIGS. 3(A) and 3(B)).

As shown in FIGS. 1 and 2, the first sidewall portion 13 is situated on the front side of the electrical connector 1. It should be noted that the first sidewall portion 13 is situated on the right side of the electrical connector 1 in FIGS. 3(A) and 3(B). Further, as shown in FIGS. 1 and 2, the housing 10 includes a first accommodating portion 10A at both outsides of the terminal arrangement range. The first accommodating portion 10A is configured as a space cut through a substantially entire portion thereof in the vertical direction including an edge portion of the first sidewall portion 13 and the edge wall portion 15. Accordingly, the movable member 50 is accommodated in the first accommodating portion 10A when the movable member 50 is situated at the close position.

As shown in FIGS. 1 and 2, the second sidewall portion 14 is situated on the back side of the electrical connector 1. It should be noted that the second sidewall portion 14 is situated on the left side of the electrical connector 1 in FIGS. 3(A) and 3(B). Further, as shown in FIGS. 5(A)-5(C) and 6(A)-6(C), the second sidewall portion 14 includes a second accommodating portion 14A at both outsides of the terminal arrangement range in the terminal arrangement direction and within the first accommodating portion 10A. The second accommodating portion 14A is configured as a hole portion penetrating through the second sidewall portion 14 in the plate thickness direction thereof (the connector width direction) within an upper edge side range thereof. Accordingly, an edge plate portion 55 of the movable member 50 (described later) is accommodated in the second accommodating portion 14A when the movable member 50 is situated at the close position.

As shown in FIG. 2, the edge wall portion 15 includes a rotational movement supporting portion 15A at a lower portion thereof and a center position thereof in the connector width direction. The rotational movement supporting portion 15A is configured to be curved such that the rotational movement supporting portion 15A is opened toward the first accommodating portion 10A.

As shown in FIG. 3(C), the rotational movement supporting portion 15A has a section having a half moon shape opening toward the right side taken along a plane perpendicular to the terminal arrangement direction. Further, the rotational movement supporting portion 15A is configured to support a rotational axis portion 53 of the movable member 50 (described later), so that the movable member 50 is rotatable.

In first embodiment, the housing 10 includes a signal terminal accommodating groove portion 17 and a ground terminal accommodating groove portion 18 arranged with a specific interval in the terminal arrangement direction. The signal terminal accommodating groove portion 17 is configured to accommodate and hold the signal terminal 20 (refer to FIG. 3(A)). The ground terminal accommodating groove portion 18 is configured to accommodate and hold the ground terminal 30 (refer to FIG. 3(B)).

In the first embodiment, the ground terminal accommodating groove portion 18 is disposed within an arrangement range of the signal terminal accommodating groove portion 17. Further, the edge wall portion 15 includes a fixing metal member accommodating groove portion 19 (refer to FIG. 3(C)) at outside of the terminal arrangement range. The fixing metal member accommodating groove portion 19 is configured to accommodate and hold the fixing metal member 40.

A configuration of each of the signal terminal 20, the ground terminal 30, and the fixing metal member 40 will be explained next. As described above, each of the signal terminal 20, the ground terminal 30, and the fixing metal member 40 is accommodated in each of the signal terminal accommodating groove portion 17, the ground terminal accommodating groove portion 18, and the fixing metal member accommodating groove portion 19, respectively.

As well shown in FIG. 2, the signal terminal 20 is formed of a sheet metal member through a punching process such that a flat plate surface thereof is maintained. As shown in FIG. 3(A), when the signal terminal 20 is accommodated in the accommodating portion 17 of the housing 10, the signal terminals 20 are arranged and held in the housing 10 such that the plate surfaces of the signal terminals 20 are aligned perpendicular to the terminal arrangement direction.

As shown in FIG. 3(A), the signal terminal 20 includes a base portion 21; a held arm portion 22; an long elastic arm portion 23; a short elastic arm portion 24; and a connecting portion 25. The base portion 21 is configured to extend in the lateral direction (the connector width direction). The held arm portion 22 is configured to extend upwardly and linearly from a right edge portion of the base portion 21.

In the first embodiment, the long elastic arm portion 23 is configured to extend upwardly and linearly from a left edge of the base portion 21. The short elastic arm portion 24 is configured to extend upwardly and linearly from the left edge of the base portion 21 and in parallel to the long elastic arm portion 23. Further, the long elastic arm portion 23 and the short elastic arm portion 24 are configured to be able to elastically deform in the connector width direction.

In the first embodiment, the connecting portion 25 is configured to extend downwardly from the right edge of the base portion 21, so that the connecting portion 25 protrudes outside the housing 10. In the following description, the held arm portion 22, the long elastic arm portion 23, and the short elastic arm portion 24 may be collectively referred to as the arm portions 22, 23, and 24, if necessary.

In the first embodiment, the held arm portion 22 includes a press-in protruding portion 22A formed on an upper edge thereof, so that the press-in protruding portion 22A is pressed in a holding groove portion 17B of the housing 10 (described later). The long elastic arm portion 23 includes an upper contact portion 23A protruding toward the right side at an upper arm portion thereof, so that the upper contact portion 23A contacts with the signal circuit portion (not shown) of the flat conductive member C.

In the first embodiment, the short elastic arm portion 24 is disposed on the right side of the long elastic arm portion 23. Further, the short elastic arm portion 24 is formed in an arm shape having a length shorter than that of the long elastic arm portion 23, and having a width (a size in the lateral direction) substantially the same as that of the long elastic arm portion 23. Further, the short elastic arm portion 24 includes an upper arm portion situated right below the upper contact portion 23A of the long elastic arm portion 23. Further, the short elastic arm portion 24 includes a lower contact portion 24A protruding toward the right side, so that the lower contact portion 24A contacts with the signal circuit portion (not shown) of the flat conductive member C.

As shown in FIG. 3(A), the upper contact portion 23A is configured to protrude by a protruding length greater than that of the lower contact portion 24A. Further, the upper contact portion 23A is configured to protrude such that a protruding tip portion thereof is situated at the same position as that of the lower contact portion 24A. Further, the upper contact portion 23A and the lower contact portion 24A are arranged such that the protruding tip portions thereof extend into the receiving portion 11 from an elastic deformation allowing groove portion 17C (described later) of the housing 10.

In the first embodiment, the connecting portion 25 is configured to extend downwardly from the right edge of the base portion 21. Further, the connecting portion 25 is configured to extend toward the right side outside the housing 10, so that a lower edge of the connecting portion 25 is connected to the signal circuit portion (not shown) of the electrical circuit board with solder.

In the first embodiment, similar to the signal terminal 20 described above, the ground terminal 30 is formed of a sheet metal member through a punching process such that a flat plate surface thereof is maintained. As shown in FIG. 3(B), when the ground terminal 30 is accommodated in the ground terminal accommodating groove portion 18 of the housing 10, the ground terminals 30 are arranged and held in the housing 10, so that the plate surfaces of the ground terminals 30 are aligned perpendicular to the terminal arrangement direction.

As shown in FIG. 3(B), the ground terminal 30 includes a base portion 31; an held arm portion 32; an elastic arm portion 33; and a connecting portion 34. The base portion 31 extend in the front-to-back direction within the lower groove 18A of the accommodating portion for ground terminals 18. The base portion 31 is configured to extend in the lateral direction (the connector width direction). The held arm portion 32 is configured to extend upwardly and linearly from a left edge of the base portion 31. The elastic arm portion 33 is configured to extend upwardly and linearly from a right edge of the base portion 31, so that the elastic arm portion 33 is capable of elastically deforming. The connecting portion 34 is configured to extend downwardly from the left edge of the base portion 31, so that the connecting portion 34 protrudes outside the housing 10. In the following description, the held arm portion 32 and the elastic arm portion 33 may be collectively referred to as the arm portions 32 and 33, if necessary.

In the first embodiment, the held arm portion 32 includes a press-in protruding portion 32A formed on an upper edge thereof, so that the press-in protruding portion 32A is pressed in a holding groove portion 18B of the housing 10 (described later). The elastic arm portion 33 includes a ground contact portion 33A protruding toward the right side at an upper arm portion thereof, so that the ground contact portion 33A contacts with the ground circuit portion (not shown) of the flat conductive member C.

As shown in FIG. 3(B), the ground contact portion 33A is configured to protrude such that a protruding tip portion thereof extends into the receiving portion 11 from an elastic deformation allowing groove portion 18C (described later) of the housing 10. The connecting portion 35 is configured to extend downwardly from the left edge of the base portion 31. Further, the connecting portion 35 is configured to extend toward the left side outside the housing 10, so that a lower edge of the connecting portion 35 is connected to the ground circuit portion (not shown) of the electrical circuit board with solder.

In the first embodiment, similar to the signal terminal 20 and the ground terminal 30 described above, the fixing metal member 40 is formed of a sheet metal member through a punching process such that a flat plate surface thereof is maintained. As shown in FIG. 3(C), when the fixing metal member 40 is accommodated in the fixing metal member accommodating groove portion 19 of the housing 10, the fixing metal member 40 is held in the housing 10, so that the plate surface of the fixing metal member 40 is aligned perpendicular to the terminal arrangement direction. In other words, the plate thickness of the fixing metal member 40 is aligned with the terminal arrangement direction. Accordingly, it is possible to significantly reduce the size of the electrical connector 1 in the terminal arrangement direction.

As shown in FIG. 3(C), the fixing metal member 40 includes a base portion 41; a first fixing leg portion 42; a second fixing leg portion 43; a regulating leg portion 44; and a engaging leg portion 45. The base portion 41 is configured to extend in the connector width direction. The first fixing leg portion 42, the second fixing leg portion 43, the regulating leg portion 44, and the securing portion 45 are configured to extend downwardly in parallel to each other. In the following description, the first fixing leg portion 42, the second fixing leg portion 43, the regulating leg portion 44, and the securing portion 45 may be collectively referred to as the leg portions 42 to 45. It should be noted that the base portion 41 connect the leg portions 42 to 45 at upper edges thereof.

In the first embodiment, the first fixing leg portion 42 is disposed at a left most position among the leg portions 42 to 45. Further, the first fixing leg portion 42 is configured to extend downwardly from the left edge of the base portion 41 up to below the lower surface of the housing 10. Further, the first fixing leg portion 42 includes a first fixing portion 42A at a lower edge thereof extending toward the left side, so that the first fixing portion 42A is fixed to a corresponding portion (not shown) of the electrical circuit board with solder.

In the first embodiment, the second fixing leg portion 43 is disposed at a right most position among the leg portions 42 to 45. Further, the second fixing leg portion 43 is configured to extend downwardly from the right edge of the base portion 41 up to below the lower surface of the housing 10. Further, the second fixing leg portion 43 includes a second fixing portion 43A at a lower edge thereof extending toward the left side and the right side, so that the second fixing portion 43A is fixed to a corresponding portion (not shown) of the electrical circuit board with solder.

In the first embodiment, the regulating leg portion 44 is disposed at a second left most position among the leg portions 42 to 45. Further, the regulating leg portion 44 is configured to extend downwardly and linearly from near the left edge of the base portion 41, so that the regulating leg portion 44 passes through the bottom wall portion 12 of the housing 10. Further, the regulating leg portion 44 includes an upper half portion and a lower half portion having a width smaller than that of the upper half portion. Further, the regulating leg portion 44 includes a regulating portion 44A at a left edge of the upper half portion, so that the regulating portion 44A restricts a position of the rotational axis portion 53 of the movable member 50 (described later). Further, the regulating leg portion 44 includes a press-in protruding portion 44B formed on an upper right edge thereof, so that the press-in protruding portion 44B is pressed in a holding groove portion 19C-1 of the housing 10 (described later).

In the first embodiment, the engaging leg portion 45 is disposed at a second right most position among the leg portions 42 to 45. Further, the engaging leg portion 45 is configured to extend downwardly and linearly from near the right edge of the base portion 41 up to slightly above the lower surface of the housing 10. Further, the engaging leg portion 45 is configured to be capable of elastically deforming in the connector width direction.

In the first embodiment, the engaging leg portion 45 has a width gradually decreasing from an upper edge thereof toward a lower portion thereof, and is configured to slightly incline toward the right side. Further, the engaging leg portion 45 includes an engaging section 45A at the lower portion thereof. The engaging section 45A is configured to have a left edge protruding in a mountain shape. Further, The engaging section 45A includes a first urging portion 45-1 at an edge portion thereof (an edge portion upwardly inclined toward the right side) above a protruding tip of the mountain shape. The first urging portion 45-1 is configured to engage with a first engaged surface 54A of an engaged portion 54 (described later) of the movable member 50, so that the first urging portion 45-1 urges the first engaged surface 54A toward the closed position (refer to FIG. 4(A)).

In the first embodiment, The engaging section 45A further includes a second urging portion 45-2 at an edge portion thereof (an edge portion downwardly inclined toward the right side) below the protruding tip of the mountain shape. The second urging portion 45-2 is configured to engage with a second engaged surface 54B of the engaged portion 54 (described later) of the movable member 50, so that the second urging portion 45-2 urges the second engaged surface 54B toward the open position (refer to FIG. 4(B)).

As described above, in the first embodiment, the fixing metal member 40 is formed as one single component of the electrical connector 1. Further, the fixing metal member 40 includes the first fixing portion 42A, the second fixing portion 43A, the regulating portion 44A, and the engaging section 45A. Accordingly, it is possible to minimize the number of the components of the electrical connector 1. Further, in the fixing metal member 40, the first fixing leg portion 42, the second fixing leg portion 43, the regulating leg portion 44, and the securing portion 45 extend in the one same direction (the downward direction). Accordingly, it is possible to insert the fixing metal member 40 into the fixing metal member accommodating groove portion 19 of the housing 10 in the one direction, thereby making it possible to easily assemble the electrical connector 1.

Further, as described above, in the first embodiment, the fixing metal member 40 includes the first fixing leg portion 42 and the second fixing leg portion 43 at the both outmost positions among the leg portions 42 to 45. Accordingly, the fixing metal member 40 can be securely fixed to the electrical circuit board at two locations. Further, the first fixing leg portion 42 is arranged away from the second fixing leg portion 43 for a large distance in the connector width direction, thereby further securely fixing the fixing metal member 40 to the electrical circuit board. It should be noted that the fixing metal member 40 does not necessarily need to include the two fixing leg portions, that is, the first fixing leg portion 42 and the second fixing leg portion 43. Alternatively, the fixing metal member 40 may include just one fixing leg portion, as long as it is possible to securely fix the fixing metal member 40 to the electrical circuit board.

As shown in FIG. 3(A), the signal terminal accommodating groove portion 17 is formed in a slit shape expanding in a direction perpendicular to the terminal arrangement direction. Further, the signal terminal accommodating groove portion 17 is configured to penetrate through the housing 10 in the vertical direction.

In the first embodiment, the signal terminal accommodating groove portion 17 includes a bottom groove portion 17A; a holding groove portion 17B; and the elastic deformation allowing groove portion 17C. The bottom groove portion 17A is configured to extend in the connector width direction at the lower portion of the housing 10. The holding groove portion 17B is configured to extend upwardly from a right edge of the bottom groove portion 17A. The elastic deformation allowing groove portion 17C is configured to extend upwardly from a left edge of the bottom groove portion 17A. It should be noted that the signal terminal 20 is fitted into the signal terminal accommodating groove portion 17 from below.

In the first embodiment, the bottom groove portion 17A is configured to accommodate the base portion 21 of the signal terminal 20. Further, the bottom groove portion 17A is configured to accommodate the lower edge of each of the arm portions 22, 23, and 24. The holding groove portion 17B includes a lower portion opened toward the left side and facing the receiving portion 11. Further, the holding groove portion 17B is configured to penetrate through the first sidewall portion 13 in the vertical direction except the lower portion thereof, so that the held arm portion 22 of the signal terminal 20 is fitted into the holding groove portion 17B.

In the first embodiment, the elastic deformation allowing groove portion 17C is recessed in an inner surface of the second sidewall portion 14 over an entire range in the vertical direction. Accordingly, the elastic deformation allowing groove portion 17C is configured to accommodate the long elastic arm portion 23 and the short elastic arm portion 24 of the signal terminal 20, so that the long elastic arm portion 23 and the short elastic arm portion 24 are capable of elastically deforming in the connector width direction (the lateral direction in FIG. 3(A)).

As shown in FIG. 3(B), the ground terminal accommodating groove portion 18 is formed in a slit shape expanding in a direction perpendicular to the terminal arrangement direction. Further, the ground terminal accommodating groove portion 18 is configured to penetrate through the housing 10 in the vertical direction.

In the first embodiment, the ground terminal accommodating groove portion 18 includes a bottom groove portion 18A; a holding groove portion 18B; and the elastic deformation allowing groove portion 18C. The bottom groove portion 18A is configured to extend in the connector width direction at the lower portion of the housing 10. The holding groove portion 18B is configured to extend upwardly from a left edge of the bottom groove portion 18A. The elastic deformation allowing groove portion 18C is configured to extend upwardly from a right edge of the bottom groove portion 18A. It should be noted that the ground terminal 30 is fitted into the ground terminal accommodating groove portion 18 from below.

In the first embodiment, the bottom groove portion 18A is configured to accommodate the base portion 31 of the ground terminal 30. The holding groove portion 18B includes a lower portion opened toward the right side and facing the receiving portion 11. Further, the holding groove portion 18B is configured to penetrate through the second sidewall portion 14 in the vertical direction except the lower portion thereof, so that the held arm portion 32 of the ground terminal 30 is fitted into the holding groove portion 18B.

In the first embodiment, the elastic deformation allowing groove portion 18C is recessed in an inner surface of the first sidewall portion 13 over an entire range in the vertical direction. Accordingly, the elastic deformation allowing groove portion 18C is configured to accommodate the elastic arm portion 33 of the ground terminal 30, so that the elastic arm portion 33 is capable of elastically deforming in the connector width direction (the lateral direction in FIG. 3(B)).

As shown in FIG. 3(C), the fixing metal member accommodating groove portion 19 is formed in a slit shape expanding in a direction perpendicular to the terminal arrangement direction. Further, the fixing metal member accommodating groove portion 19 is configured to penetrate through the housing 10 in the vertical direction.

In the first embodiment, the fixing metal member accommodating groove portion 19 includes an upper groove portion 19A; an outer groove portion 19B; and an inclined groove portion 19C. The upper groove portion 19A is configured to extend in the connector width direction (the lateral direction in FIG. 3(C)) at the lower portion of the housing 10. The outer groove portion 19B is configured to extend downwardly from a left half of the upper groove portion 19A. The inclined groove portion 19C is configured to extend downwardly from a right half of the upper groove portion 19A. It should be noted that the fixing metal member 40 is fitted into the fixing metal member accommodating groove portion 19 from above.

In the first embodiment, the upper groove portion 19A is configured to accommodate the base portion 41 of the fixing metal member 40. The outer groove portion 19B is recessed in an outer surface of the edge wall portion 15 and an outer surface of the bottom wall portion 12 (a surface on the left side in FIG. 3(C)) over an entire range in the vertical direction. Accordingly, the outer groove portion 19B is configured to accommodate an entire portion of the fixing metal member 40 except the fixing portion 42A of the first fixing leg portion 42 of the fixing metal member 40.

As shown in FIG. 3(C), the outer groove portion 19B is separated from the inclined groove portion 19C in the connector width direction with a separation wall portion 15B of the edge wall portion 15 extending in the vertical direction. Further, the outer groove portion 19B is configured to communicate with the first accommodating portion 10A through a hole portion 15B-1 at a lower portion of the separation wall portion 15B. The hole portion 15B-1 is configured to penetrate through the separation wall portion 15B at a position corresponding to the rotational movement supporting portion 15A. Further, the hole portion 15B-1 is configured to accommodate the rotational axis portion 53 of the movable member 50 (described later).

In the first embodiment, the inclined groove portion 19C includes an opening on both the left side and the right side thereof. Further, the inclined groove portion 19C is configured to communicate with the first accommodating portion 10A.

As shown in FIG. 3(C), the inclined groove portion 19C includes a lower edge inclined downwardly toward the lower side and extending in the terminal arrangement direction up to just below the rotational movement supporting portion 15A (also refer to FIG. 2). Further, an island shape portion 15C is disposed at below the inclined groove portion 19C. The island shape portion 15C is situated at the center position in the connector width direction, and is configured to extend in the vertical direction and connect opposite inner wall surfaces constituting the inclined groove portion 19C (in the direction perpendicular to the sheet surface of FIG. 3(C)).

In the first embodiment, the inclined groove portion 19C further includes a holding groove portion 19C-1 between the separation wall portion 15B and the island shape portion 15C, so that the holding groove portion 19C-1 accommodates the upper portion of the regulating leg portion 44 and holds the regulating leg portion 44. Further, the inclined groove portion 19C is configured to accommodate the upper edge portions of the second fixing leg portion 43 and the engaging leg portion 45 at the right side thereof. It should be noted that, except the upper edge portions thereof, the second fixing leg portion 43 and the engaging leg portion 45 are arranged to protrude from the inclined groove portion 19C, and are situated in the first accommodating portion 10A.

A configuration of the movable member 50 will be described next with reference to FIG. 2 showing the movable member 50 situated at the closed position. It should be noted that the movable member 50 is rotated in a closing direction (the counterclockwise direction in FIG. 3(C)) from the open position to the closed position, and is rotated in an opening direction (the clockwise direction in FIG. 3(C)) from the closed position to the opening direction.

As shown in FIG. 2, the movable member 50 includes a main body portion 51; a joining portion 52; the rotational axis portion 53; the engaged portion 54; and an edge plate portion 55. The main body portion 51 is formed in a plate shape as an operation portion extending in the terminal arrangement direction as a longitudinal direction thereof. The joining portion 52 is disposed at both edges of the main body portion 51 in the terminal arrangement direction. The edge plate portion 55 is situated near the both edges of the main body portion 51 in the terminal arrangement direction.

As shown in FIGS. 3(A) and 3(B), when the movable member 50 is situated at the closed position, an inner surface of the movable member 50 (the left side surface of the movable member 50 in FIGS. 3(A) and 3(B) and aligned perpendicular to the connector width direction) abuts against the outer surface of the first sidewall portion 13 of the housing 10, so that the movable member 50 is prevented from rotating in the closing direction.

In the first embodiment, the main body portion 51 is operated so that the movable member 50 is rotated between the closed position (refer to FIG. 3(C) and FIG. 4(A) and the open position (refer to FIG. 4(B)). The main body portion 51 includes a release operating portion 51A at a front end thereof (a right end in FIG. 3(A)) at the closed position, so that the release operating portion 51A is operated when the movable member 50 is rotated from the closed position to the open position.

As shown in FIGS. 3(A) and 3(B), a space is formed between the release operating portion 51A and the outer surface of the first sidewall portion 13 of the housing 10. Accordingly, it is possible to hook the release operating portion 51A with a finger, so that the movable member 50 is rotated in the opening direction. As a result, it is possible to disengage the engaging portion 55C from the engaged portion C2A of the flat conductive member C (described later).

As shown in FIG. 2, the joining portion 52 is disposed on two locations at the both edges of the main body portion 51 in the terminal arrangement direction, such that plate surfaces thereof perpendicular to the terminal arrangement direction face each other with a distance in between. Further, the joining portion 52 is configured to extend downwardly from the front side toward the backside of the main body portion 51.

As shown in FIG. 3(C), the rotational axis portion 53 is configured to extend in the terminal arrangement direction at a position corresponding to the rotational movement supporting portion 15A of the housing 10. Further, the rotational axis portion 53 is configured to connect lower left edges of the joining portions 52. Accordingly, the rotational axis portion 53 is connected to the main body portion 51 through the joining portions 52.

As shown in FIG. 3(C), the rotational axis portion 53 is configured to have a circular section taken along the plane perpendicular to the terminal arrangement direction. Accordingly, the rotational movement supporting portion 15A of the housing 10 supports a circumferential surface of the rotational axis portion 53 as a supported portion (also refer to FIGS. 4(A) and 4(B)).

As shown in FIG. 3(C) and FIGS. 4(A) and 4(B), the rotational axis portion 53 is rotated around a rotation center 53A represented with a cross mark. Further, the rotational axis portion 53 is situated between the first fixing leg portion 42 of the fixing metal member 40 and the regulating portion 44A of the regulating leg portion 44, so that the regulating portion 44A prevents the rotational axis portion 53 from coming out from the rotational movement supporting portion 15A.

As shown in FIG. 3(C), the engaged portion 54 is configured to connect the opposite plate surfaces of the joining portions 52 at lower right edges of the joining portions 52. Further, the joining portion 54 is disposed between the regulating leg portion 44 and the engaging leg portion 45 of the fixing metal member 40. Further, the joining portion 54 is arranged to engage with the engaging section 45A of the engaging leg portion 45 of the fixing metal member 40. Accordingly, the joining portion 54 receives an urging force toward the closed position or the open position from the engaging section 45A.

As shown in FIG. 3(C), the engaged portion 54 is configured to have an inclined surface such that an upper surface approaches a lower surface on the right side toward the right side viewed in the terminal arrangement direction. Accordingly, the engaged portion 54 is formed in a shape having a corner protruding toward the right side.

As shown in FIG. 3(C) and FIG. 4(A), the engaged portion 54 includes a first urged surface 54A at the corner thereof. The first urged surface 54A is arranged to receive the urging force toward the closed position from the first urging portion 45A-1 of the engaging section 45A of the fixing metal member 40.

As shown in FIG. 4(B), the engaged portion 54 includes a second urged surface 54B on a surface near at the corner thereof among the upper surface of the engaged portion 54. The second urged surface 54B is arranged to receive the urging force toward the open position from the second urging portion 45A-2 of the engaging section 45A of the fixing metal member 40.

As shown in FIG. 2, the edge plate portion 55 is arranged to have a plate surface extending perpendicular to the terminal arrangement direction. Further, the edge plate portion 55 is situated at an inner position relative to the joining portion 52, the rotational axis portion 53, and the engaged portion 54 in the terminal arrangement direction.

As shown in FIGS. 5(A) and 5(C), the edge plate portion 55 includes a penetrating groove portion 55A formed in an inner surface (an inner plate surface) thereof in the terminal arrangement direction. The penetrating groove portion 55A is configured to extend and penetrate in the vertical direction at a center position in the connector width direction (the lateral direction in FIGS. 5(A) and 5(C)). When the movable member 50 is moved to a specific angular position (a passage allowing position), the penetrating groove portion 55A is arranged to form a passage allowing space (described later), so that the engaged portion C2A of the flat conductive member C can pass through (refer to FIG. 5(B) and FIG. 6(B)).

As shown in FIGS. 5(A) and 5(C), the penetrating groove portion 55A is formed in a groove shape, such that the penetrating groove portion 55A is slightly inclined downwardly toward the left side when the movable member 50 is situated at the closed position.

As shown in FIGS. 5(A) and 5(C), the movable member 50 further includes an interfering portion 55B (described later). The interfering portion 55B is situated on the right side of the penetrating groove portion 55A and at a position situated in a range of the receiving portion 11 of the housing 10 in the connector width direction.

In the first embodiment, the interfering portion 55B includes an interfering surface 55B-1 on a left edge surface thereof (a surface constituting the penetrating groove portion 55A). The interfering surface 55B-1 is configured to gradually incline downwardly toward the left side. When the flat conductive member C is inserted into the electrical connector 1, the interfering surface 55B-1 abuts against and interferes with the ear portion C2 of the flat conductive member C entering into the penetrating groove portion 55A from above. Accordingly, the interfering surface 55B-1 receives the abutting force, so that the movable member 50 is rotated toward the open position (refer to FIG. 5(B)).

As shown in FIGS. 5(A) and 5(C), the movable member 50 further includes an engaging portion 55C below the interfering portion 55B. The engaging portion 55C is configured to be capable of engaging with the engaged portion C2A of the flat conductive member C receiving an upward force when the flat conductive member C is completely inserted and the movable member 50 is situated at the closed position.

Figure 3:
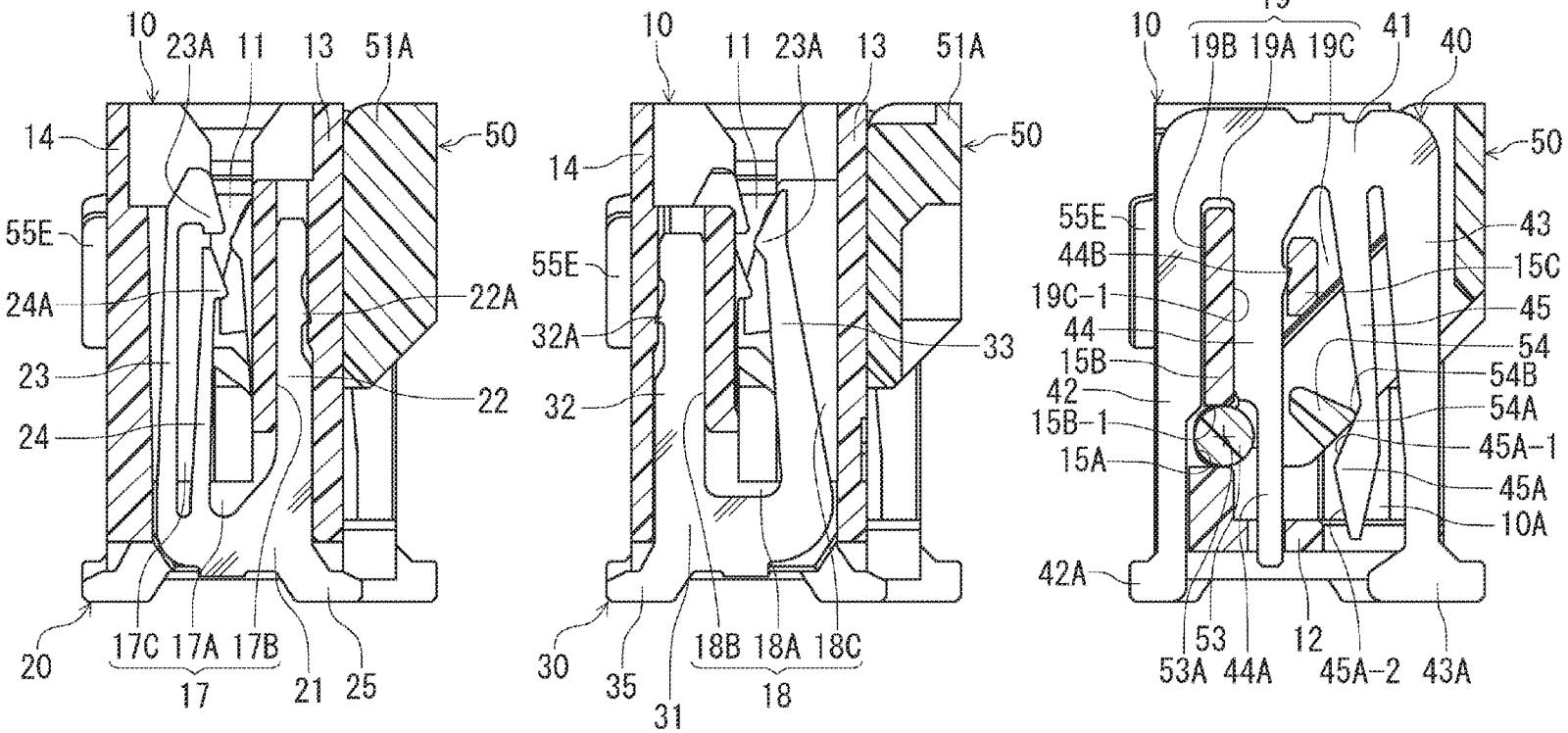

As shown in FIG. 3 and FIGS. 5(A) and 5(C), the engaging portion 55C is situated on the right side of the rotational axis portion 53 when the movable member 50 is situated at the closed position. When the engaging portion 55C receives the pulling out force from the engaged portion C2A upwardly, the engaging portion 55C generates a moment such that the movable member 50 is rotated in the closing direction around the rotational center 53A of the rotational axis portion 53.

As shown in FIGS. 5(A) and 5(C), the engaging portion 55C as the lower surface of the engaging portion 55C is formed of an inclined surface inclined downwardly toward the left side when the movable member 50 is situated at the closed position, so that the engaging portion 55C is capable of engaging with the engaged portion C2A. Further, the engaging portion 55C is arranged such that a distance between a left edge of the engaging portion 55C and an inner wall surface 11A of the receiving portion 11 in the connector width direction is smaller than the thickness of the flat conductive member C. Accordingly, the engaging surface 55C-1 can securely engage with the flat conductive member C.

As shown in FIGS. 5(A) and 5(C), the movable member 50 further includes a pressure receiving portion 55D. The pressure receiving portion 55D is situated on the right side of the penetrating groove portion 55A of the edge plate portion 55. Further, the pressure receiving portion 55D is configured to be capable of abutting against the engaged portion C2A of the flat conductive member C receiving the upward force when the movable member 50 is situated at the open position (also refer to FIG. 6(B)).

As shown in FIGS. 5(A) and 5(C), the pressure receiving portion 55D includes a pressure receiving surface 55D-1 as a right side surface thereof inclined downwardly toward the left side when the movable member 50 is situated at the closed position, so that the pressure receiving surface 55D-1 is capable of abutting against the engaged portion C2A.

In the first embodiment, the pressure receiving surface 55D-1 is inclined downwardly toward the left side when the movable member 50 is situated at any position in addition to the closed position. Accordingly, when the pressure receiving surface 55D-1 receives the abutting force upwardly from the engaged portion C2A, the pressure receiving surface 55D-1 receives a force component generating a moment such that the movable member 50 is rotated in the closing direction around the rotational center 53A of the rotational axis portion 53.

As shown in FIGS. 5(A) and 5(C), the movable member 50 further includes a display portion 55E at a left edge of the edge plate portion 55. The display portion 55E is arranged to protrude from the left side surface (the outer surface) of the second sidewall portion 14 of the housing 10 when the movable member is situated at the closed position.

In the first embodiment, when the flat conductive member C is completely inserted into the electrical connector 1 (a completely inserted state, described later), the display portion 55E protrudes from the outer surface of the second sidewall portion 14. Further, when the flat conductive member C is not completely inserted into the electrical connector 1 (an incompletely inserted state, described later), the display portion 55E does not protrude from the outer surface of the second sidewall portion 14, that is, the display portion 55E is retracted from the outer surface of the second sidewall portion 14. It should be noted that, at this moment, an outer surface of the display portion 55E may be flush with the outer surface of the second sidewall portion 14.

An operation of assembling the electrical connector 1 having the configuration described above will be explained next.

Firstly, as shown in FIGS. 3(A) and 3(B), the signal terminals 20 are fitted into the signal terminal accommodating groove portions 17 of the housing 10 from below, so that the signal terminals 20 are attached to the housing 10. Further, the ground terminals 30 are fitted into the ground terminal accommodating groove portions 18 of the housing 10 from below, so that the ground terminals 30 are attached to the housing 10.

In the next step, the movable member 50 is inserted into the first accommodating portion 10A of the housing 10 from sideway, so that the movable member 50 is attached to the housing 10. As a result, the engaged portion 54 is supported on the rotational movement supporting portion 15A, so that the movable member 50 is capable of rotating (refer to FIG. 3(C)).

As shown in FIGS. 5(A) and 5(B), the interfering portion 55B and the engaging portion 55C of the side plate portion 55 are situated inside the receiving portion 11 of the housing 10. The pressure receiving portion 55D of the side plate portion 55 is situated inside the second accommodating portion 14A of the housing 10. Further, the display portion 55E of the side plate portion 55 protrudes from the second sidewall portion 14 of the housing 10. It should be noted that the operation of attaching the signal terminals 20, the operation of attaching the ground terminals 30, and the operation of attaching the movable member 50 may be performed in an arbitrary order or at the same time.

In the next step, the fixing metal member 40 is attached to the housing 10. As shown in FIG. 3(C), after the fixing metal member 40 is attached to the housing 10, the fixing portions 42A and 43A of the fixing leg portions 42 and 43 protrude from the bottom surface of the housing 10. Further, the lower half of the regulating leg portion 43 is situated on the right side of the rotational axis portion 53 of the movable member 50. Accordingly, the rotational axis portion 53 is restricted at the specific position, and is maintained to be supported on the rotational axis portion 15A.

Further, after the fixing metal member 40 is attached to the housing 10, the engaging section 45A of the engaging leg portion 44 is situated on the right side of the engaged portion 54 of the movable member 50. Accordingly, the first urging portion 45A-1 of the engaging section 45A urges the first urged portion 54A of the engaged portion 54 toward the closed position, so that the movable member 50 is maintained at the closed position.

An operation of connecting the electrical connector 1 to the flat conductive member C will be explained next with reference to FIGS. 3(A)-3(C) through 5(A)-5(C).

First, the connecting portions 25 of the signal terminals 20 and the connecting portions 35 of the ground terminals 30 of the electrical connector 1 are connected to the corresponding circuit portions of the electrical circuit board with solder. In addition, the fixing portions 42A and 43A of the fixing metal member 40 are fixed to the corresponding portions of the electrical circuit board with solder.

In the next step, as shown in FIG. 5(A), the movable member 50 of the electrical connector 1 is rotated to the closed position. Afterward, the flat conductive member C is placed above the electrical connector 1 such that the flat conductive member C extends in the direction (the vertical direction) perpendicular to the mounting surface of the electrical circuit board (not illustrated).

In the next step, the flat conductive member C is inserted into the receiving portion 11 of the electrical connector 1 such that the flat conductive member C faces downwardly.

In the first embodiment, when the flat conductive member C is inserted into the receiving portion 11 of the electrical connector 1, the flat conductive member C moves forward such that the flat conductive member widens the space between the ground contact portions 33A of the elastic arm portions 33 of the ground terminals 30 and the upper contact portions 23A of the long elastic arm portions 23 of the signal terminals 20 (refer to FIG. 3(B), and between the ground contact portions 33A of the elastic arm portions 33 of the ground terminals 30 and the lower contact portions 24A of the short elastic arm portions 24 (refer to FIG. 3(A). As a result, the elastic arm portions 33 of the ground terminals 30 are elastically deformed toward the right side, and the long elastic arm portions 23 and the short elastic arm portions 24 of the signal terminals 20 are elastically deformed toward the left side.

In the first embodiment, when the flat conductive member C is inserted into the receiving portion 11 of the electrical connector 1, the ear shape portion C2 disposed on both edges of the flat conductive member C enters the penetrating groove portion 55A of the movable member 50. Afterward, the ear shape portion C2 abuts against the interfering surface 55B-1 of the interfering portion 55B at a front edge thereof, so that the movable member 50 is rotated in the opening direction.

As a result, as shown in FIG. 5(B), the ear shape portion C2 supports the interfering surface 55B-1 from below, and the movable member 50 is rotated to a maximum rotational angle. In other words, the movable member 50 is rotated to an insertion allowing position (the passage allowing position), so that the flat conductive member C can be further inserted.

In the first embodiment, when the movable member 50 is rotated to the insertion allowing position (the passage allowing position), the engaged portion 54 of the movable member 50 (refer to FIG. 3(C)) is also rotated in the opening direction. Accordingly, the engaged portion 54 pushes the first urging portion 45-1 of the fixing metal member 40 at the first urged surface 54A thereof, so that the engaging leg portion 45 is elastically deformed toward the right side in FIG. 3(C). As a result, the first urging portion 45-1 urges the first urged surface 54A of the engaged portion 54 in the closing direction due to the restoration force of the engaging leg portion 45.

Further, in the first embodiment, when the flat conductive member C is inserted into the receiving portion 11 of the electrical connector 1, the rotational angle of the movable member 50 becomes the maximum when the movable member 50 is rotated to the insertion allowing position shown in FIG. 5(B). It should be noted that the corner portion of the engaged portion 54 (the right edge portion in FIG. 3(C)) does not move over the protruding top portion of the engaging section 45A of the engaging leg portion 45. Accordingly, when the flat conductive member C is inserted into the receiving portion 11 of the electrical connector 1, the engaged portion 54 does not receive the urging force toward the open position.

As shown in FIG. 5(C), when the flat conductive member C is further inserted into the receiving portion 11 of the electrical connector 1, the ear shape portion C2 of the flat conductive member C passes over the engaging portion 55C of the movable member 50, so that the flat conductive member C reaches the insertion completion position. When the flat conductive member C is completely inserted into the receiving portion 11 of the electrical connector 1, the long elastic arm portion 23 and the short elastic arm portion 24 of the signal terminal 20 are maintained in the elastically deformed state. Accordingly, the upper contact portion 23A and the lower contact portion 24A of the signal terminal 20 contacts with the signal circuit portion (not shown) on the left surface of the flat conductive member C with the contact pressure, so that the signal terminal 20 is maintained to electrically connect to the signal circuit portion (not shown) of the flat conductive member C.

Further, when the flat conductive member C is completely inserted into the receiving portion 11 of the electrical connector 1, the elastic arm portion 33 of the ground terminal 30 is maintained in the elastically deformed state. Accordingly, the ground contact portion 33A of the ground terminal 30 contacts with the ground circuit portion (not shown) on the upper surface of the flat conductive member C with the contact pressure, so that the ground terminal 30 is maintained to electrically connect to the ground circuit portion (not shown) of the flat conductive member C. Through the process described above, the flat conductive member C is connected to the electrical connector 1.

In the first embodiment, when the flat conductive member C reaches the complete insertion position, the ear shape portion C2 of the flat conductive member C passes over and is situated below the engaging portion 55C of the movable member 50. Accordingly, the engaging leg portion 45 of the fixing metal member 40 urges the movable member 50 in the closing direction, so that the movable member 50 is returned to the closed position. As a result, the engaging portion 55C enters the cut portion C1 of the flat conductive member C from above as shown in FIG. 5(C).

Further, the engaged portion C2A of the flat conductive member C is situated at the position where the engaged portion C2A is capable engaging with the engaging surface 55C-1 of the engaging portion 55C. Accordingly, it is possible to prevent the flat conductive member C from being pulled out upwardly.

As described above, in the first embodiment, when the flat conductive member C is completely inserted into the electrical connector 1, the movable member 50 is automatically returned to the closed position. Accordingly, it is not necessary to operate and return the movable member 50 to the closed position after the flat conductive member C is completely inserted into the electrical connector 1. As a result, it is possible to connect the flat conductive member C to the electrical connector 1 with the simple operation.

As shown in FIG. 5(C), when the movable member 50 is automatically returned to the closed position, the display portion 55E of the movable member 50 is returned to the regular position, so that the display portion 55E protrudes from the outer surface (the left surface) of the second sidewall portion 14. Accordingly, it is possible to visibly confirm that the display portion 55E protrudes from the outer surface of the second sidewall portion 14, and the flat conductive member C is completely inserted into the receiving portion 11 of the housing 10.

As shown in FIG. 4(A), when the movable member 50 is automatically returned to the closed position, the first urging portion 45-1 of the engaging section 45A of the engaging leg portion 45 engages with the first urged surface 54A of the engaged portion 54 with the urging force. Accordingly, even when the movable member 50 receives an inadvertent external force and is moved in the opening direction while the electrical connector 1 is connected to the flat conductive member C, the movable member 50 is pushed back with the urging force from the first urging portion 45A-1. As a result, the movable member 50 is not inadvertently rotated to the open position.

Further, in the first embodiment, when the flat conductive member C receives an inadvertent pulling out force upwardly while the electrical connector 1 is connected to the flat conductive member C, the engaged portion C2A of the flat conductive member C engages with the engaging surface 55C-1 of the engaging portion 55C of the movable member 50 from below. It should be noted that the rotational axis portion 53 and the engaging surface 55C-1 of the movable member 50 are arranged such that the movable member 50 is urged to rotate in the closing direction. Accordingly, it is possible to securely maintain the engaged portion C2A of the flat conductive member C to engage with the engaging surface 55C-1 of the engaging portion 55C of the movable member 50.

Further, in the first embodiment, when the movable member 50 is situated at the closed position, the movable member 50 interferes with the first sidewall portion 13 of the housing 10. Accordingly, the movable member 50 is prevented from rotating in the closing direction. As a result, even when the engaging surface 55C-1 of the engaging portion 55C of the movable member 50 receives the pulling out force from the engaged portion C2A of the flat conductive member C, the movable member 50 is not rotated in the closing direction.

Further, as described above, in the first embodiment, the engaging surface 55C-1 of the engaging portion 55C is inclined downwardly toward the left side when the movable member 50 is situated at the closed position. Accordingly, the engaged portion C2A receives the force toward the right side along the engaging surface 55C-1 in the direction that the engaged portion C2A is moved away from the penetrating groove portion 55A. In other words, the engaged portion C2A receives the force in the direction opposite to the direction that the engaged portion C2A is disengaged from the engaging portion 55C. Accordingly, it is possible to securely engage the engaged portion C2A with the engaging portion 55C.

As described above, in the first embodiment, when the flat conductive member C is completely inserted into the receiving portion 11 of the electrical connector 1, the display portion 55E of the movable member 50 protrudes from the outer surface of the housing 10. On the other hand, when the flat conductive member C is not completely inserted into the receiving portion 11 of the electrical connector 1, that is, the flat conductive member C is in the halfway inserted state, the ear shape portion C2 of the flat conductive member C does not pass over the engaging portion 55C of the movable member 50, and abuts against the interfering surface 55B-1 of the interfering portion 55B.

Accordingly, as shown in FIG. 5(B), the movable member 50 is slightly rotated in the opening direction. As a result, the display portion 55E of the movable member 50 is retracted from the outer surface of the second sidewall portion 14 of the housing 10, and is situated inside the second accommodating portion 14A. Accordingly, when the display portion 55E of the movable member 50 is retracted from the outer surface of the second sidewall portion 14 of the housing 10, it is possible to visibly confirm that the flat conductive member C is in the halfway inserted state. When it is visibly confirmed that the flat conductive member C is in the halfway inserted state, it is possible to completely insert the flat conductive member C through inserting the flat conductive member C into the housing 10 one more time.

In the first embodiment, from the side opposite to the second sidewall portion 14, it may be difficult to visibly confirm that the display portion 55E of the movable member 50 is retracted from the outer surface of the second sidewall portion 14 of the housing 10. In this case, alternatively, it is possible to sensuously confirm whether the display portion 55E of the movable member 50 is retracted from the outer surface of the second sidewall portion 14 of the housing 10 through touching the second accommodating portion 14A at the outer surface of the second sidewall portion 14.

An operation of pulling out the flat conductive member C from the electrical connector 1 will be described next with reference to FIGS. 4(A)-4(B) through 6(A)-6(C).

First, as shown in FIG. 5(C), when the electrical connector 1 is connected to the flat conductive member C, the release operating portion 51A of the movable member 50 of the electrical connector 1 is hooked with a finger. Accordingly, as shown in FIG. 4(B) and FIG. 6(A), the movable member 50 is rotated toward the open position against the urging force toward the closed position from the engaging portion 45A of the regulating leg portion 44 of the fixing metal member 40. At this moment, as shown in FIG. 6(A), the engaging portion 55C is moved upwardly, that is, in the direction that the engaging portion 55C is released from the cut portion C1 of the flat conductive member C.

In the next step, when the movable member 50 is rotated to the open position, the corner portion of the engaged portion 54 of the movable member 50 elastically deforms the engaging leg portion 45 of the fixing metal member 40 toward the right side. It should be noted that, until the corner portion of the engaged portion 54 reaches the protruding top of the engaging section 45A of the engaging leg portion 44, the first urging portion 45A-1 of the engaging section 45A urges the movable member 50 toward the closed position.

In the next step, when the movable member 50 is rotated further, and the corner portion of the engaged portion 54 is moved over the protruding top of the engaging section 45A of the engaging leg portion 44 up to the second urging portion 45A-2, the engaging leg portion 45 is returned in the direction (toward the left side) to reduce the elastic deformation of the engaging leg portion 45. Further, the engaging leg portion 45 urges the engaged portion 54 toward the open position.

As shown in FIG. 4(B), when the movable member 50 is rotated to the open position, the second urging portion 45A-2 of the engaging section 45A urges and is engaged with the second urged surface 54B of the engaged portion 54. Accordingly, even when the movable member 50 receives an external force, the movable member 50 is returned to the open position, and is stably maintained at the open position.

Further, as shown in FIG. 6(A), when the movable member 50 is rotated to the open position, the engaging portion 55C is completely moved out from the cut portion C1 of the flat conductive member C, so that the engaging portion 55C is disengaged from the cut portion C1 of the flat conductive member C.

Further, as shown in FIG. 6(A), the pressure receiving portion 55D of the movable member 50 enters the cut portion C1 from below. Accordingly, the pressure receiving portion 55D of the movable member 50 is situated at the position that the pressure receiving portion 55D of the movable member 50 is capable of engaging with the engaged portion C2 in the pulling out direction.

In the next step, as shown in FIG. 6(B), when the flat conductive member C is pulled out backwardly, the engaged portion C2A of the flat conductive member C abuts against the pressure receiving surface 55D-1 of the pressure receiving portion 55D of the movable member 50. At this moment, the movable member 50 is situated at the open position. Accordingly, different from when the movable member 50 is situated at the closed position, the first sidewall portion 13 of the housing 10 does not prevent the movable member 50 from rotating toward the closed position.

Accordingly, as shown in FIG. 6(B), when the engaged portion C2A of the flat conductive member C abuts against the pressure receiving surface 55D-1 of the pressure receiving portion 55D of the movable member 50, the movable member 50 is rotated toward the closed position against the urging force toward the open position from the engaged portion 45A of the engaging leg portion 45 of the fixing metal member 40. It should be noted that, at this member, the engaged portion 54 elastically deform the engaging leg portion 45 toward the right side in FIG. 4(B).

In the next step, as shown in FIG. 6(C), when the penetrating groove portion 55A reaches the passage allowing position while the movable member 50 is rotated toward the closed position, the engaged portion C2A of the flat conductive member C passes through the penetrating groove portion 55A in the pulling out direction. Accordingly, it is possible to easily pull out the flat conductive member C.

As described above, in the first embodiment, the first fixing portion 42A, the second fixing portion 43A, the regulating portion 44A, and the engaging section 45A are disposed on the first fixing leg portion 42, the second fixing leg portion 43, the regulating leg portion 44, and the engaging leg portion 45, respectively. Alternatively, at least two of the first fixing portion 42A, the second fixing portion 43A, the regulating portion 44A, and the engaging section 45A may be disposed on the same leg portion.

Second Embodiment

A second embodiment of the present invention will be explained next.

Figure 7:
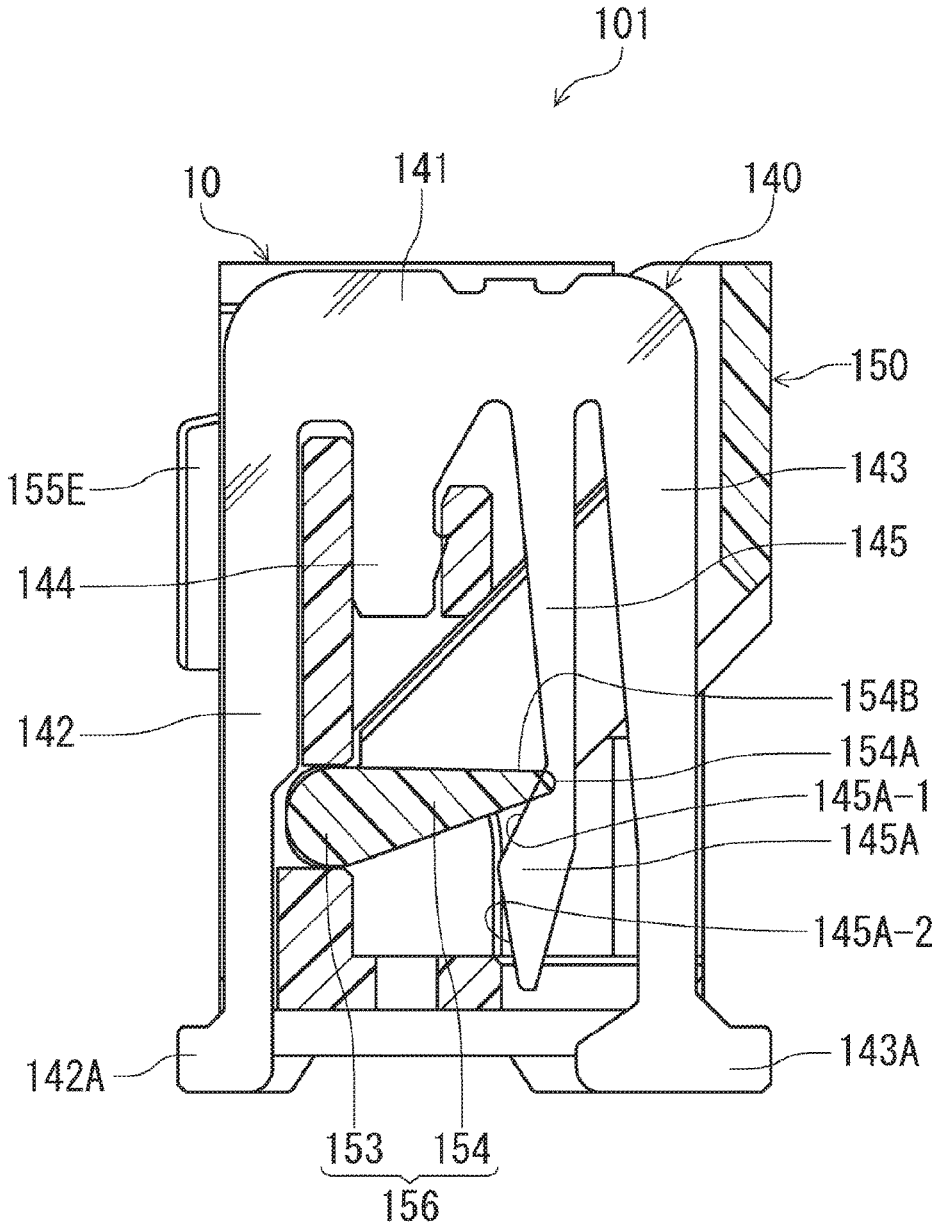
FIG. 7 is a sectional view showing an electrical connector for connecting the flat conductive member taken along a plane perpendicular to a terminal arrangement direction of the electrical connector according to a second embodiment of the present invention.

FIG. 7 is a sectional view showing an electrical connector 101 for connecting the flat conductive member taken at a location of a fixing metal member 140 along a plane perpendicular to a terminal arrangement direction of the electrical connector 101 according to the second embodiment of the present invention.

As described above, in the first embodiment, the regulating portion 44A and the engaging section 45A of the fixing metal member 40 are separately disposed on the leg portions (the regulating leg portion 44 and the engaging leg portion 45). On the other hand, in the second embodiment, the electrical connector 101 includes the fixing metal member 140 and a movable member 150. The movable member 150 includes a rotational axis portion 153. Further, the fixing metal member 140 includes an engaging leg portion 145, and an engaging section 145A is disposed on the engaging leg portion 145 for restricting the position of the rotational axis portion 153.

In the second embodiment, the electrical connector 101 further includes the housing 10, the signal terminals (not shown), and the ground terminals (not shown) having the configurations similar to those in the first embodiment. Accordingly, explanations thereof are omitted. Further, the fixing metal member 140 and the movable member 150 have configurations similar to those of the fixing metal member 40 and the movable member 50 except several differences. In the following description, the differences of the fixing metal member 140 and the movable member 150 will be mainly explained, and similar portions thereof are designated with numbers added with 100 to the portions in the first embodiment, and explanations thereof are omitted.

In the second embodiment, the fixing metal portion 140 includes the regulating leg portion 144 having a length shorter than that of the regulating leg portion 44 of the fixing metal member 40 in the first embodiment. Further, the fixing metal portion 140 does not have the regulating portion 44A. Accordingly, the fixing metal portion 140 includes a held leg portion 144 at the second location from the left side among the leg portions (corresponding to the regulating leg portion 44). The held leg portion 144 is configured just to be tightly fitted into the housing 10.

In the second embodiment, the fixing metal portion 140 further includes the engaging leg portion 144. The engaging leg portion 144 is formed in a shape similar to that of the engaging leg portion 44 of the fixing metal member 40 in the first embodiment. The engaging leg portion 144 includes an engaging section 145A, so that the engaging section 145A is engaged with an engaged portion 154 of a cam portion 156 (described later) and restricts the position of the cam portion 156.

In the second embodiment, it is not necessary to separately dispose the regulating portion 44A and the engaging section 45A. Accordingly, it is possible to form the fixing metal member 140 in a simple shape.

In the second embodiment, the movable member 150 includes the cam portion 156 having functions similar to those of the rotational axis portion 53 and the engaged portion 54 of the movable member 50 in the first embodiment. It should be noted that the movable member 150 has a configuration similar to that of the movable member 50 except the cam portion 156.

In the second embodiment, the cam portion 156 integrally includes a rotational axis portion 153 and an engaged portion 154. The rotational axis portion 153 is configured to be supported on the rotational movement supporting portion 15A of the housing 10, so that the rotational axis portion 153 is capable of rotating. The engaged portion 154 is configured to extend toward the right side from the rotational axis portion 153.

In the second embodiment, the rotational axis portion 153 includes an edge portion as a left half portion thereof having a circular arc shape, so that the rotational axis portion 153 is supported on the rotational movement supporting portion 15A at the edge portion thereof to be rotatable.

In the second embodiment, the engaged portion 154 has a size gradually decreasing toward the right side. Further, the engaged portion 154 includes a first urged surface 154A at a distal end portion (a right side edge portion) with a round shape, so that the first urged surface 154A receives an urging force toward the closed position from the first urging surface 145A-1 of the engaging section 145A of the engaging leg portion 145. Further, the engaged portion 154 includes a second urged surface 154B on an upper surface thereof near the right side edge portion, so that the second urged surface 154B receives an urging force toward the open position from the first urging surface 145A-1 of the engaging section 145A of the engaging leg portion 145.

As shown in FIG. 7, the right edge portion of the engaged portion 154 is shown as overlapping with the engaging section 145A. In the actual configuration, the engaging leg portion 145 is slightly deformed elastically toward the right side, so that the first urging surface 145A-1 of the engaging section 145A urges the first urged surface 154A of the engaged portion 154 toward the closed position.

In the second embodiment, when the movable member 50 is situated at any angle position, the engaging section 145A of the engaging leg portion 145 abuts against the engaged portion 154 of the cam portion 156, so that the engaging section 145A of the engaging leg portion 145 urges the engaged portion 154 of the cam portion 156 toward the closed position or the open position. Accordingly, the position of the cam portion 156 or the rotational axis portion 153 is restricted, so that it is possible to securely prevent the rotational axis portion 153 from coming off the rotational moment supporting portion 15A.

As described above, in the first embodiment and the second embodiment, the flat conductive member C is inserted into and pulled out from the electrical connector 1 and the electrical connector 101 in the direction perpendicular to the mounting surface of the electrical circuit board. It should be noted that the present invention may be applicable to an electrical connector that receives the flat conductive member C in the direction in parallel to the mounting surface of the electrical circuit board.

The disclosure of Japanese Patent Application No. 2016-165555, filed on Aug. 26, 2016, is incorporated in the application by reference.

While the present invention has been explained with reference to the specific embodiments of the present invention, the explanation is illustrative and the present invention is limited only by the appended claims.

What is claimed is:

1. An electrical connector to be mounted on an electrical circuit board, and to be connected to a flat conductive member, comprising:

a housing including a receiving portion for inserting the flat conductive member therein;

a plurality of terminals arranged in the housing in a terminal arrangement direction;

a movable member; and a fixing metal member held with the housing, wherein said movable member includes a supported portion and an engaging portion, said supported portion is supported on the housing so that the movable member is movable between an open position and a closed position, said engaging portion is configured to engage with an engaged portion formed in the flat conductive member when the movable member is situated at the closed position, said fixing metal member includes a fixing portion to be fixed to the electrical circuit board; a regulating portion for restricting the movable member; and an engaging section for engaging with the movable member at one of the open position and the closed position, said fixing metal member further includes a plurality of leg portions extending toward the electrical circuit board, and each of said fixing portion, said regulating portion, and said engaging portion is disposed on one of the leg portions.

2. The electrical connector according to claim 1, wherein said fixing portion is disposed at least two of the leg portions located both ends in the terminal arrangement direction.

3. The electrical connector according to claim 1, further comprising an urging member for urging the movable member toward one of the open position and the closed position.

4. The electrical connector according to claim 1, wherein said engaging portion is disposed outside a range where the terminals are arranged.

5. The electrical connector according to claim 1, wherein said inserting portion is configured so that the flat conductive member is inserted into the inserting portion in a direction perpendicular to the electrical circuit board.

* * * * *